US010170220B2

(12) United States Patent
Cornelison et al.

(10) Patent No.: US 10,170,220 B2
(45) Date of Patent: Jan. 1, 2019

(54) EXTENDED FREQUENCY RANGE BALANCED TWISTED PAIR TRANSMISSION LINE OR COMMUNICATION CABLE

(71) Applicant: HITACHI CABLE AMERICA, INC., Manchester, NH (US)

(72) Inventors: Kenneth E. Cornelison, Cincinnati, OH (US); Semko Bukvic, Manchester, NH (US)

(73) Assignee: Hitachi Cable America, Inc., Manchester, NH (US)

( * ) Notice: Subject to any disclaimer, the term of this patent is extended or adjusted under 35 U.S.C. 154(b) by 0 days.

(21) Appl. No.: 15/416,294

(22) Filed: Jan. 26, 2017

(65) Prior Publication Data

US 2017/0213621 A1 Jul. 27, 2017

Related U.S. Application Data

(60) Provisional application No. 62/395,054, filed on Sep. 15, 2016, provisional application No. 62/287,646, filed on Jan. 27, 2016.

(51) Int. Cl.
*H01B 11/04* (2006.01)
*H01B 11/08* (2006.01)
(Continued)

(52) U.S. Cl.
CPC ..... *H01B 11/08* (2013.01); *H01B 7/0216* (2013.01); *H01B 11/1895* (2013.01)

(58) Field of Classification Search
CPC ..... H01B 11/04; H01B 11/06
(Continued)

(56) References Cited

U.S. PATENT DOCUMENTS 3,102,160 A 8/1963 Cook et al.
3,433,890 A 3/1969 Gabriel et al.
(Continued)

FOREIGN PATENT DOCUMENTS

WO 01/08167 A1 2/2001
WO 02/084675 A1 10/2002
WO 2016/149349 A1 9/2016

OTHER PUBLICATIONS

International Search Report & Written Opinion issued in corresponding International Patent Application No. PCT/US2016/022617 dated Jun. 21, 2016.
(Continued)

*Primary Examiner* — Chau N Nguyen
(74) *Attorney, Agent, or Firm* — Davis & Bujold PLLC; Michael J. Bujold

(57) ABSTRACT

A cable which comprises a plurality of pairs of first and second insulated conductors. The first and the second insulated conductors, of each pair, are twisted with one another to form a twisted pair and each of the twisted pairs has a different lay length from one another. Each of the plurality of twisted pairs is wrapped with a hoop strength wrap which maintains a mechanical strength and integrity of the twisted pair during subsequent handing thereof, and a circumference of the hoop strength wrap is about 5% or less than a dielectric pair minimum circumference of the first and the second insulated conductors of the twisted pair. At least one metallic wrap is provided for shielding and grounding of the plurality of twisted pairs. The plurality of twisted pairs and the at least one metallic tape are surrounded and encased by a conventional exterior jacket to form the cable.

20 Claims, 15 Drawing Sheets

(51) Int. Cl.
*H01B 7/02* (2006.01)
*H01B 11/18* (2006.01)

(58) Field of Classification Search
USPC ..... 174/113 R, 36
See application file for complete search history.

(56) References Cited

U.S. PATENT DOCUMENTS 3,894,172 A 7/1975 Jachimowicz et al.
4,873,393 A 10/1989 Friesen et al.
5,486,649 A * 1/1996 Gareis ..... H01B 11/1016 174/10
5,767,441 A 6/1998 Brorein et al.
5,770,820 A 6/1998 Nelson et al.
6,222,129 B1 4/2001 Siekierka et al.
6,222,130 B1 * 4/2001 Gareis ..... H01B 11/02 174/113 AS
6,255,594 B1 * 7/2001 Hudson ..... H01B 7/295 174/121 A
6,452,107 B1 * 9/2002 Kebabjian ..... H01B 11/002 174/113 R
6,566,605 B1 5/2003 Prudhon
6,815,611 B1 * 11/2004 Gareis ..... H01B 11/1025 174/113 R
7,193,155 B2 3/2007 McMillan et al.
7,612,289 B2 11/2009 Lique et al.
7,834,271 B2 * 11/2010 Gromko ..... H01B 11/085 174/113 AS
2003/0150638 A1 8/2003 Patel
2005/0006132 A1 * 1/2005 Clark ..... H01B 7/184 174/113 C
2006/0185885 A1 8/2006 McMillan et al.
2010/0126620 A1 * 5/2010 Johnson ..... H01B 11/04 140/118
2015/0332808 A1 11/2015 Nordin et al.

OTHER PUBLICATIONS

International Search Report issued in corresponding International Patent Application No. PCT/US2017/015054 dated May 14, 2017.
Written Opinion of the International Searching Authority issued in corresponding International Patent Application No. PCT/US2017/015054 dated May 14, 2017.

* cited by examiner

RIGHT HAND REGULAR LAY

LEFT HAND REGULAR LAY

RIGHT HAND LANG'S LAY

LEFT HAND LANG'S LAY

EXTENDED FREQUENCY RANGE BALANCED TWISTED PAIR TRANSMISSION LINE OR COMMUNICATION CABLE

This application claims the benefit of U.S. provisional application Ser. Nos. 62/395,054 and 62/287,646 filed Sep. 15, 2016 and Jan. 27, 2016, respectively.

FIELD OF THE INVENTION

The present invention relates to data communication cables that have an extended frequency range of at least 2 Ghz.

BACKGROUND OF THE INVENTION

In all transmission lines, the electrical parameters are determined by the physical dimensions and electrical properties of the components. It is common to have periodic or random variations in those properties that induce inconsistencies in the electrical transmission parameters. Within the frequency range of prior cable standards, several design approaches and prior art have been developed in an attempt in order to reduce the effect of those variations.

Insertion loss and return loss characteristics can have abrupt changes at specific frequencies that are related to the electrical wave interacting with the periodicity of the transmission line variations. If the signal wavelengths are sufficiently longer than the perturbations in the cable construction, then the effect of frequency dependent electrical parameters is much less evident or non-existent. However, if the signal wavelengths are in the same range as the cable perturbations, then the effect on the signal transmission is much more pronounced at those specific signal wavelengths that correlate with the dimension of the transmission line anomalies.

A particular source of anomalies in cable performance occurs when the pairs are assembled together. FIG. 1 shows the insertion loss results for a typical cable with non-shielded pairs and an overall metallic shield designed for 500 MHZ. A number of insertion loss electrical response anomalies exist below 2000 MHZ, and anomalies also occur in the return loss measurement results.

Another example is a cable with individually shielded pairs, with each pair being surrounded by a metal shield layer. The manufacturing processes cause periodic variations in spacing from conductor to conductor as well as spacing of the conductors to the pair shield. These variations cause anomalies in the insertion loss and return loss measurements as shown in FIG. 2.

The process of manufacturing a completed cable causes periodic mechanical perturbations. It is known that tension consistency and care in handling of the cable components is important. It was also discovered that one of the effects caused by the twisting action is the unintended spiral that is induced in the cable components by the twisting action. The spiral length is the same as the twist length. In rotating machinery, it is also common to have a slightly different path for the wire from the payoff spool through the machine as it turns. The periodic changing path in the wire results in having different sections of the components which bend and flex differently than other sections. The differences in bending lead to slight periodic differences in the mechanical structure in the cable and is one cause for anomalies in the electrical measurement results.

In FIG. 3, an insertion loss notch occurs at about 1.2 GHz while other insertion loss notches occur in the 2 GHz region and are due to the effect of the cabling process. Changing the process equipment can help reduce the notches (representing these insertion losses), but such changes in the process equipment do not completely eliminate the notches. The problems inherent in the process machinery, and thus the effects thereof still remain.

For shielded pairs, surrounding the pairs with a metallic tape is known to provide electrical isolation from one pair to the next pair. However, metallic tapes are generally not of sufficient tightness in order to provide the pair dimensional integrity to avoid electrical anomalies in the final cable test results. FIG. 4 shows the results of a cable with a metallic pair which is wrap with a wrap length of about 1 inch, but this arrangement does not provide the desired effect due to the relative looseness of the longer tape wrap. It is to appreciated that longer lengths of the wrap of the pair results in even less tightness and less mechanical integrity. A relatively short spiral length of the metallic tape over the twisted pair is needed to provide the necessary mechanical integrity for the wrapped pair.

However the metallic spiral shield wrap construction with a relatively short spiral alone was not found to provide the necessary shielding effectiveness. It was discovered that a combination shield could be employed such that a metallic tape wrap with a shorter lay length is applied over metallic wrap with a long lay length or in a longitudinal fashion. Note that a lay length is traditionally defined as the axial distance necessary for one pair of insulated conductors to complete a full 360 degree of rotation when twisting about one another, such that a tighter twist will result in a shorter lay length while a looser twist will result in a longer lay length. One arrangement is to have the conductive surface of the inner tape facing away from the pair and the shorter lay metallic tape with a metallic conductive surface on both sides to provide electrical contact with the inner longitudinal tape and to adjacent similar shielded pairs in the assembled cable.

FIG. 6 shows the improved crosstalk performance of a combination of two metallic shield tapes, compared to a single metallic wrapped tape with a short spiral, as shown in FIG. 5.

Cabling twist length can be chosen to be below about 0.5 wavelengths of the highest frequency of operation in order to move the cabling process and design electrical anomalies beyond the frequency of interest. However, at frequencies in the range of 2,000 MHZ, this approach has drawbacks due to the additional path length of the pairs within the shorter spiral length of each pair as well as a crushing action caused by the short lay lengths in the cable. This generally leads to problems in meeting specifications for cable propagation delay and insertion loss. However, with the design options provided by the pair wrapping, much longer cable lay lengths can be utilized, avoiding the problems caused by short cable lay lengths.

For the new extended frequency electrical requirements, the prior art does not solve all the problems found in designing and manufacturing such a cable, and some of the prior art techniques cause, rather than solve, problems at these extended frequency ranges.

Pretwisting (U.S. Pat. No. 5,767,441—Brorein '441) was introduced to eliminate the random effect of conductor to conductor spacing, but It is to appreciated that this arrangement also generates its own problems in the new frequency ranges of interest. The random conductor to conductor spacing caused undesirable effects in the electrical parameter of return loss. Although this technology is widely used in the data communication cable industry, it was discovered that the pretwisting of the conductor also results in degradation of electrical properties, such as return losses, due to conductor deformation effects. Those effects are now visible in the extended frequency range of interest.

Bonded pair technology (U.S. Pat. No. 6,222,129—Siekierka et al. '129) is a technology which controls the return loss parameters of a twisted pair by maintaining the conductor to conductor spacing. The main advantage of bonded pairs is to prevent the need for pretwisting of the conductor. However, such bonding does not control the spacing of the wires in the pair to pair shield or to an overall cable shield, so other means must be employed to establish and control the electrical properties defined by the interaction of the pairs to the cable shield components.

For non-shielded pairs, tightly wrapping or coating the two wires of a pair with a dielectric material is one technique for establishing and maintaining the mechanical integrity of the pair.

With respect to category 8 cables, it is to appreciated that such cables increase the frequency of operation for category cables to 2 GHz or more. This change reduces the electrical wavelength in the cable so that mechanical perturbations in the cable are longer than the electrical wavelength.

Until Category 8 cables, the periodicity length of manufacturing operations is longer than the electrical wavelength. However, this changes with Category 8 cables.

When frequencies greater than 2 GHz are required, even shorter periodicity lengths are required and this, in turn, substantially increases the electrical delay and insertion loss effects.

Other cable designs have performance above 2 GHz, but the industry desires to have a cable construction that is very similar to existing Category 6 and 7 constructions. Such similarity of construction allows ease of adapting cable connectors, termination practices, installation ease and familiarity, etc.

The periodicity length in the cable is accompanied by an insertion loss notch at the frequency corresponding to the length. A return loss spike accompanies the insertion loss notch. With conventional equipment, even equipment with updated design and controls, the periodic perturbations cause insertion loss and return loss results that do not meet the cable specifications.

The inventors have discovered that the root cause for the electrical problems result from one or more minor inconsistencies in the mechanical structure of the cable, over its entire axial length, which are normally caused by the associated manufacturing equipment, e.g., cabling of the cable core assembly during manufacture of the cable.

SUMMARY OF THE INVENTION

Wherefore, it is an object of the present invention to overcome the above mentioned shortcomings and drawbacks associated with the prior art.

The foregoing and other features and advantages will be apparent from the following description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

It is an object of the present invention, according to one embodiment, to provide a dielectric material or wrap which binds, wraps or otherwise immobilizes the (two) first and second insulated conductors of a twisted-pair, in order to prevent relative movement between the two insulated conductors.

It is a further object of the invention, according to one embodiment, to provide a metallic material which binds, wraps, or otherwise immobilizes the two insulated conductors, of a twisted pair, and also provides effective shielding from one pair to another pair.

A further object of the present invention is to wrap the insulated conductors of the twisted pairs, with a longer lay length, with a material which increases the propagation delay of the insulated conductors in order to compensate for the propagation delays which occur in the twisted pairs with the shorter lay length(s).

Yet another object of the present invention is to utilize materials which have different dielectric constant(s) so as to equalize the propagation delay among the twisted pairs in the cable. That is, lower dielectric constant materials, such as foamed insulation, may be utilize as the conductor insulation for the twisted pairs with the shorter lay length(s) while higher dielectric constant materials, such as using solid insulation, may be utilize as the conductor insulation for the twisted pairs with the longer lay length(s). In addition, the twisted pair or pairs having the longer lay length(s) may be wrapped with a material having a high dielectric constant in order to equalize the propagation delay among the twisted pairs of the cable.

A novel way of assembling cable for Category 8 requirements is to assemble twisted pairs, in a longitudinal direction or fashion. Thus, the twisted pairs extend along a longitudinal along a common axis. A key to this approach is to provide a wrap or layer over the shielded pairs that creates a mechanically robust structure for the assembly of longitudinal components within.

The advantage of this arrangement is that there generally are not any mechanical perturbations caused by a cabling together of the 4 pairs with their shield tapes, since there is no cabling action upon the core at this stage of manufacture.

Thereafter, once the cable assembly is complete with a final wrap or layer over the assembly, it is much less susceptible to subsequent twisting to form the desired spiral of the twisted pairs, so a wide range of cable lay lengths is thus available.

For cables with a metal shield over each pair, the pair shield tapes can be applied longitudinally, placed in predetermined positions and held in place by the core wrap/layer. This cabling method could also be used when the pairs within the core are either unwrapped or wrapped.

As a result of conventional cabling operations, if the cable lay length is greater than about 5 to 7 inches for example, the inventors have discovered that such components, because of the long and loose spiral of the cable core, tend to 'fall apart' before the subsequent manufacturing operations.

However, with the completed core with a wrap/layer, the range of cable lay lengths extend from essentially infinity down to a very few inches (i.e., 1.5-4 inches for example). Of course the insertion loss and electrical delay problems still exist with short cable lay lengths, but this construction allows cable lay lengths up to 8 to 20 inches. Such long lay lengths are generally not practical with conventional cabling processes. And these longer lay lengths improve insertion loss(es) and electrical delay(s) compared to conventional processes. For installation integrity and use, such long cable lengths can be sufficient, but not attainable with conventional processes due to the dimensional and structure instability of the long lay core.

Another advantage with this approach is that when used with shielded pairs, the overlaps of metal shield tapes over each pair can have a specific orientation, and be held in that orientation by the core wrap/layer while in a longitudinal configuration. One specific example is to apply the tapes such they each of the overlapped edges face away from the center of the common axis. According to this arrangement, any signal leakage that escapes the overlapped tape has minimal effect on electrical crosstalk from pair to pair. Another example is to only have the overlap at specific locations in order to provide a balance of electrical crosstalk between the pairs, or between adjacent cables. It is the core wrap/layer design that allows this flexibility of tape placement in a core with a longitudinal configuration. This tape orientation is maintained in subsequent operations, since the wrap/layer allows the elements to twist together as an assembly.

A further object of the invention is to utilize a metallic shielding layer, having with a dual layered folded-over longitudinal edge, so as to result in direct metal-to-metal contact, between two overlapped longitudinal edge sections of the metallic shielding tape, in an overlapped longitudinal edge region, and the metallic shielding tape and thereby both (1) provides a complete 360 degree circumferential metallic shielding around the twisted pair, and (2) ensures that this complete 360 degree circumferential metallic shielding, around the twisted pair, extends completely and uninterrupted from a first leading end of the metallic shielding tape to an opposed second trailing end of the metallic shielding tape thereby by providing a complete, uninterrupted metallic shield, for the twisted pair, which is devoid of any break(s), gap(s) and/or small or minute interruption(s) in the metallic shield provide by the metallic shielding layer. The metallic shield, which completely surrounds and extends uninterrupted from a first end of the twisted pair to a second opposed end of the twisted pair, is effective in eliminating an indirect spiral conductive path which can be present if direct metal-to-metal contact does not occur between the two overlapped longitudinal edge sections of the metallic shielding tape.

Still another object of the invention is to utilize a metallic shielding layer, which has a dual layered folded-over longitudinal edge, which wraps around a twisted pair and has a wrap length of between 0.25 and 2.5 inches thereby to result in direct metal-to-metal electrical contact between the two overlapped longitudinal edge sections of the metallic shielding tape in the overlapped longitudinal edge region.

The present invention further relates to a cable comprising: a plurality of twisted pairs, and each of the plurality of twisted pairs comprising first and second insulated conductors; the plurality of twisted pairs being assembled with one another to form a cable core assembly; and the cable having at least one of a hoop wrap having at least one of sufficiently short lay length or a sufficient hoop strength so as to increase mechanical strength and integrity of the cable to prevent degradation caused by periodicity of deformations induced by cabling action during assembly of the cable.

The present invention further relates to a cable comprising: a plurality of pairs, with each pair comprising first and second insulated conductors; the first and the second insulated conductors, of each of the plurality of pairs, being twisted with one another to form a twisted pair, and each of the twisted pairs having a different lay length from one another so that one of the plurality of twisted pairs has a shortest lay length and another of the plurality of twisted pairs has a longest lay length; each of the plurality of twisted pairs being wrapped with a hoop strength wrap which maintains mechanical strength and integrity of each of the twisted pairs during subsequent handing thereof, and a circumference of hoop strength wrap is about 5% or less than a pair minimum circumference of the first and the second insulated conductors of the twisted pair; at least one metallic wrap being for provide shielding and grounding of the plurality of twisted pairs; and the plurality of twisted pairs and the at least one metallic tape being surrounded and encased by a conventional exterior jacket to form the cable.

The present invention also relates to a cable comprising: a plurality of twisted pairs, and each of the plurality of twisted pairs comprising first and second insulated conductors; a plurality of metallic shielding tapes with each one of the metallic shielding tapes comprising both a metallic layer and a dielectric layer, and one longitudinal edge of each one of the plurality of metallic shielding tapes being folded over onto itself to form a dual layered folded-over longitudinal edge which extends along a longitudinal length of the respective metallic shielding tape; each one of the plurality of twisted pairs being wrapped by only a single one of the plurality of metallic shielding tapes to form a metal-to-metal contact which extends completely around a circumference of the twisted pair, and each metallic shielding tape increases a mechanical strength and integrity of the twisted pair and prevents degradation caused by periodicity of deformations induced by cabling action during assembly of the cable; and the plurality of twisted pairs, each wrapped by only a single one of the plurality of metallic shielding tapes, being assembled with one another to form a cable core assembly.

The foregoing and other features and advantages will be apparent from the following more particular description of exemplary embodiments of the disclosure, as illustrated in the accompanying drawings, in which like reference characters refer to the same parts throughout the different views. The drawings are not necessarily to scale, emphasis instead being placed upon illustrating the principles of the disclosure.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

DETAILED DESCRIPTION OF PREFERRED EMBODIMENTS

The following non-limiting examples further illustrate the various embodiments described herein.

It was surprisingly discovered by the inventors that the pretwisting operation itself—such as in accordance with the teachings of Brorein '441 briefly discussed above—induces a specific periodicity in the twisted pairs 14, 16, 18 or 20 that results in significant electrical performance anomalies. The conductor pretwist length is often determined for conventional cable designs as a percent of the pair twist length. However, in order to prevent electrical anomalies at extended frequency ranges that are caused by conductor deformation during the twisting action, it was discovered that the pretwist length for each one of the first and the second insulated conductors 24, 26 must be less than the ½ wavelength of the highest frequency of the intended operation.

Figure 1:
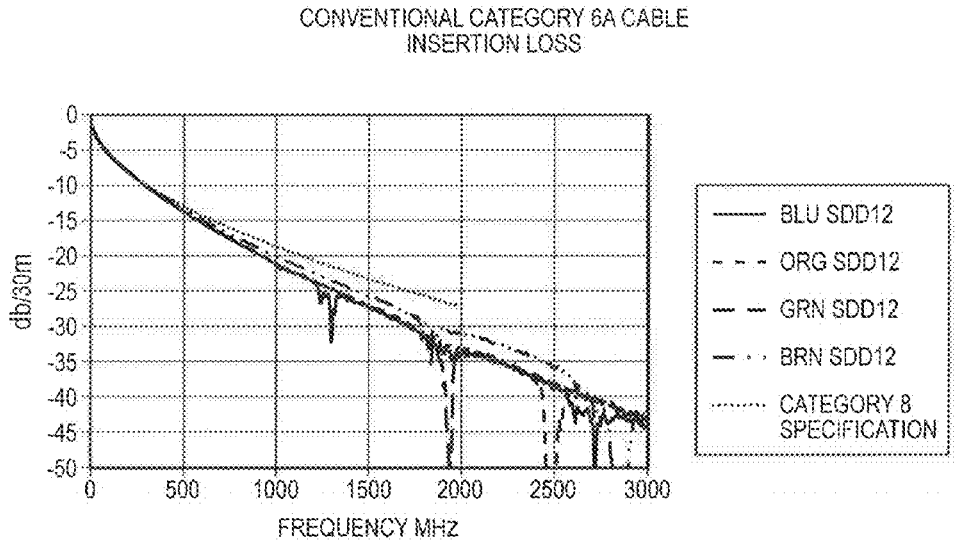
FIG. 1 shows the insertion loss results for a typical cable with non-shielded pairs and an overall metallic shield designed for 500 MHZ.
Figure 2:
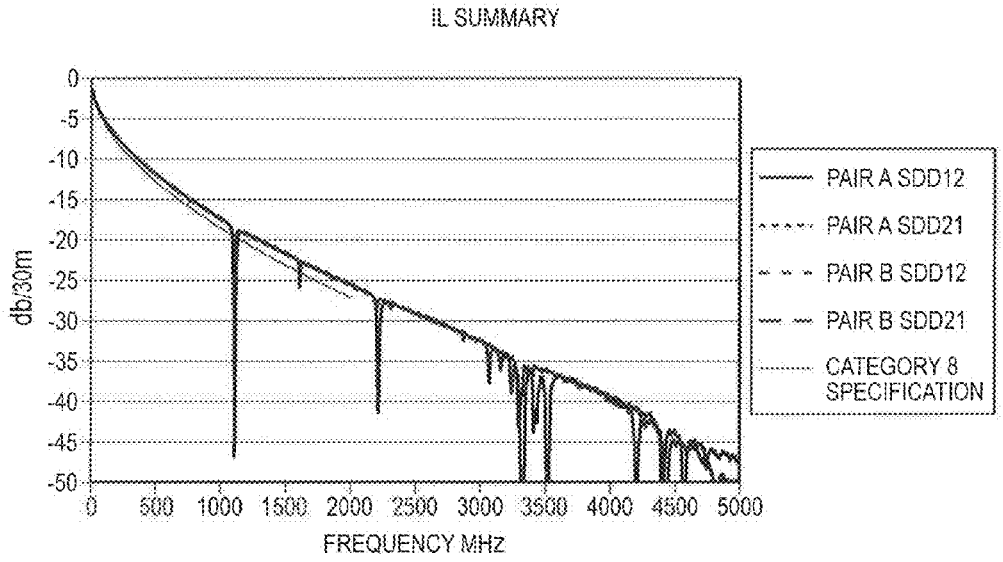
FIG. 2 shows anomalies in the insertion loss and return loss measurements.
Figure 3:
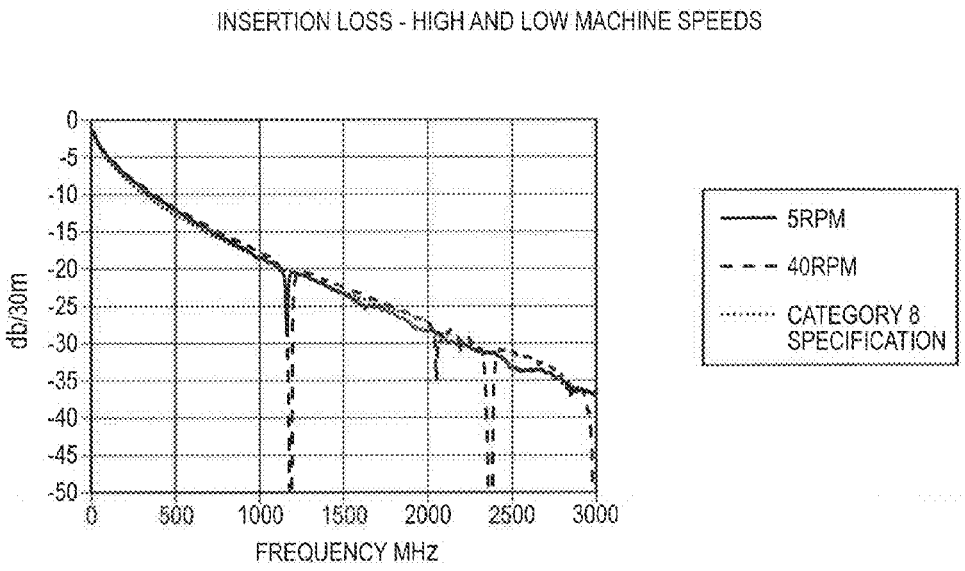
FIG. 3 shows an insertion loss notch at about 1.2 GHz as well as other insertion loss notches in the 2 GHz region due to the effect of the cabling process.
Figure 4:
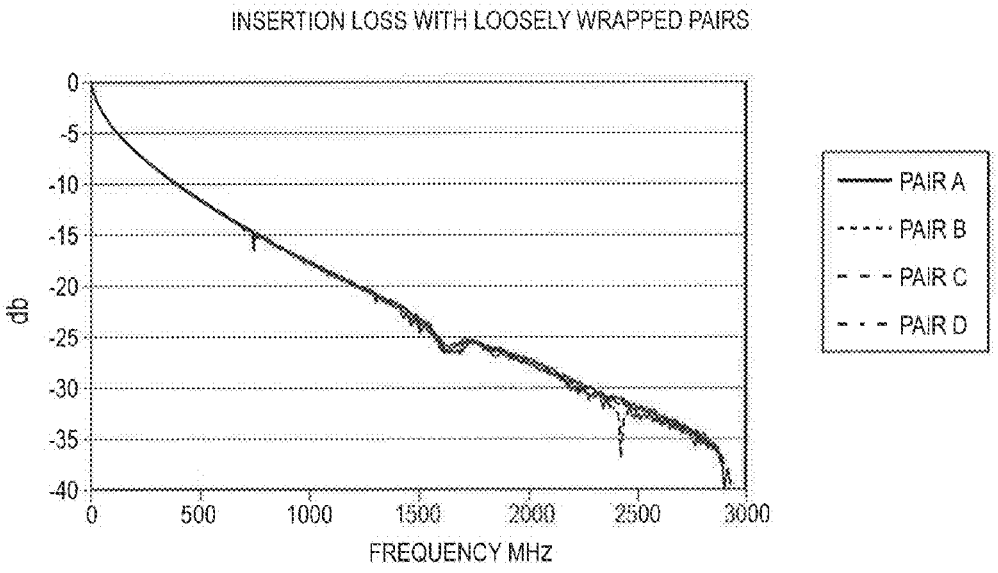
FIG. 4 shows results of a cable with a metallic pair wrap with a wrap length of about 1 inch which does not provide a desired effect due to the relative looseness of a longer tape wrap.
Figure 5:
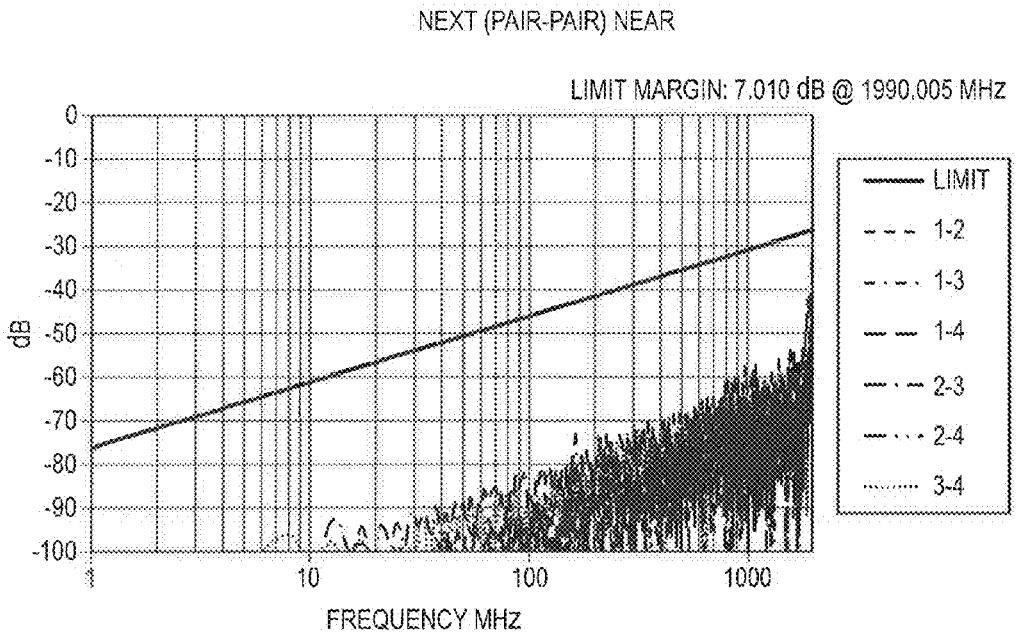
FIGS. 5 and 6 show the improved crosstalk performance of a combination of two shield tapes compared to a single wrapped tape.
Figure 6:
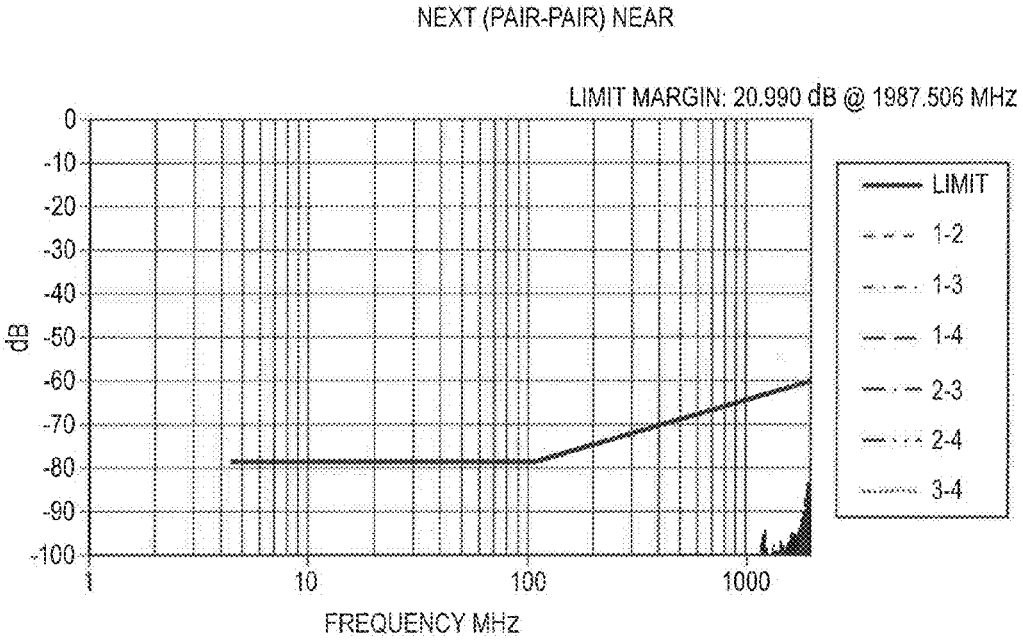
Figure 7:
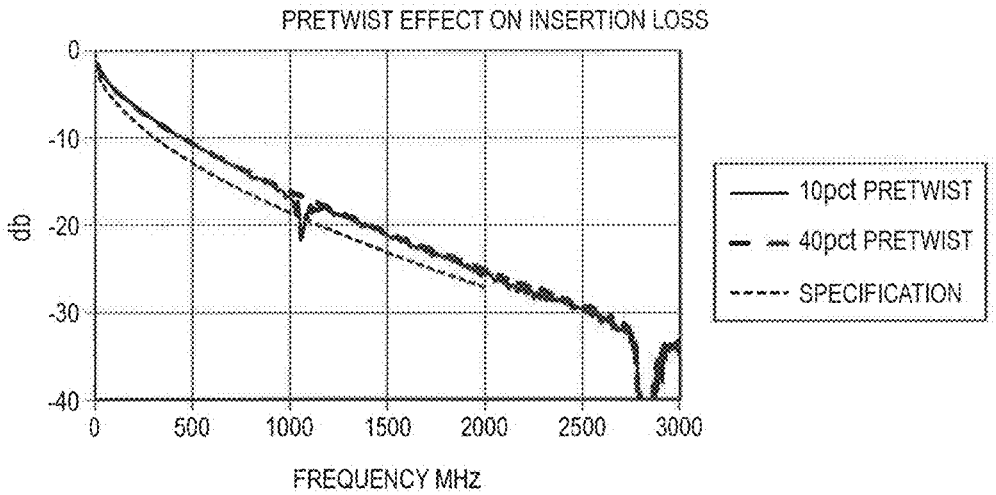
FIG. 7 shows the effect of the pretwist on insertion loss (IL) when the pretwist length is the same as half wavelength of the electrical signal.

It is important to provide pretwisting of each insulated conductor at a twist rate within certain bounds in order to prevent undesirable interactions. FIG. 7 shows the effect of the pretwist on insertion loss (IL) when the pretwist length is the same as half wavelength of the electrical signal. For instance with a 10% rate, the pretwist length is 10 times the twist length of the pair; with a 40% rate, the pretwist length is 2.5 times the length of the pair. In this example, the 40% pretwist rate is short enough to avoid electrical property anomalies beyond 2 GHz. In practice, a suitable pretwist lay length is approximately 1.5 inches.

Figure 8:
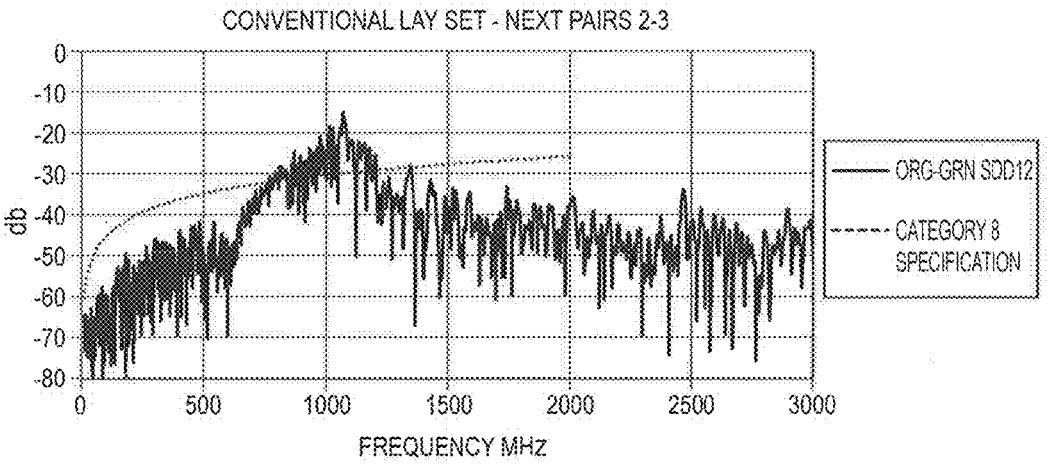
FIG. 8 shows a crosstalk curve of a typical cable designed for operation up to 500 MHZ.
Figure 9:
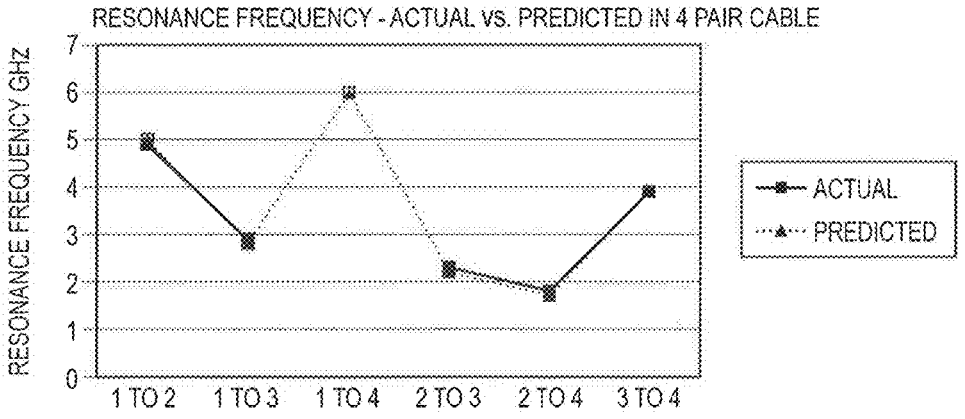
FIG. 9 shows the results of a cable trial where the predicted pair crosstalk frequency and actual observed crosstalk frequency are compared.

For pairs without an individual pair shield, it was discovered that an electrical crosstalk resonance occurs at high frequencies that are not visible in the frequency ranges of the previous cable standards. The resonance length occurs at a distance where the number of electrical lay lengths in one pair compared to another differs by one. FIG. 8 shows a crosstalk curve of a typical cable designed for operation up to 500 MHZ. However, this cable has a crosstalk resonance, for one of the pairs, at about 1,000 MHZ. The other pair combinations also have this resonance at a frequency that depends on the lay length differences between the respective pairs. With the lay lengths typically used in the industry for existing category cable ratings, crosstalk resonances exist at frequencies below the intended range of operation for the new cable standards. FIG. 9 shows the results of a cable trial where the predicted pair crosstalk frequency and actual observed crosstalk frequency are compared to one another. This resonance must be moved beyond the frequency of operation for extended frequency ranges, such that the resonance length is less than ½ the wavelength of the highest frequency range of operation.

It has also been found that the tightness and the strength of the pair wrapping has distinct effects on the mechanical stability and electrical performance of the twisted pair. Moreover, the lay length and the hoop strength of the at least one wrapping is an important parameter of the cable.

For non-shielded pairs, tightly wrapping the two wires of a pair with a dielectric material or wrap is one technique or mechanism for establishing and maintaining the mechanical strength and integrity of the pair of insulated conductors of the twisted pair and preventing the two (i.e., the first and the second) insulated conductors from becoming sufficiently separated from one another during, for example, subsequent manufacture, handing and/or installation of the cable. It is also discovered that the twisted pairs with the shorter twist lengths have a higher degree of mechanical integrity and strength, due to the relatively short twist length of the two wires or insulated conductors, than a twisted pair with a relatively long twist length. In view of this, the inventors have determined that it is generally necessary for at least the two insulated conductors, of the twisted pair with the longest twist or lay length, to be tightly wrapped or coated with a (e.g., dielectric or metallic) wrap. The lay length of the pair wrap is preferably from between 0.33 inches to 1.5 inches in order to provide a sufficient hoop strength.

It was discovered that a difference in an electrical delay, along the length of the cable, typically needs to be controlled in order to meet the electrical requirements of the cable since the difference in the lay lengths of unshielded twisted pairs must be larger than in conventional cables in order to control the crosstalk resonance of the cable. It is to be appreciated that the twisted pairs with the shorter lay lengths, which have a relatively long electrical path, i.e., have more delay, than twisted pairs with longer lay lengths, which have a relatively shorter electrical path. In order to compensate for the delay in the twisted pairs with the shorter lay lengths, the longer lay lengths are preferably wrapped with a dielectric material or wrap which thereby increases the propagation delay of the pair to the pair, compared to not wrapping the twisted pair with any (dielectric) material or wrap. By wrapping at least the twisted pair, and preferably both of the twisted pairs, having the longer lay lengths and leaving the one, or both of the twisted pairs, having the shorter lay lengths unwrapped, the propagation delay differences, between the longer lay lengths and the shorter lay lengths, are thereby reduced and the desired balance of electrical properties can be achieved to meet the pair to pair differential time delay requirements as well as provide control for the mechanical structure of the pair.

It was also discovered that for non-shielded pairs in an overall shielded construction, there is an insertion loss interaction with the cable shield that depends on the lay length of the non-shielded pair. It was noted that a significant increase in insertion loss occurs when the electrical wavelength of the signal in the cable is about ¼ or less of the lay length of the twisted pair. Accordingly, in order to provide a smooth curve for insertion loss, the lay length of the twisted pair should be sufficiently short, e.g., be less than about ¼ the wavelength of the highest frequency of operation.

One problem with avoiding the crosstalk resonances is that the lay length differences between the twisted pairs of the cables is much larger than found in cables designed for operation at lower frequencies. The ratio of the shortest lay length to the longest lay length, in a four (4) twisted pair cable, can approach 3 to 4, for example, where a conventional cable may have a ratio of the shortest lay length to the longest lay length of 2 or less, for example.

Figure 16:
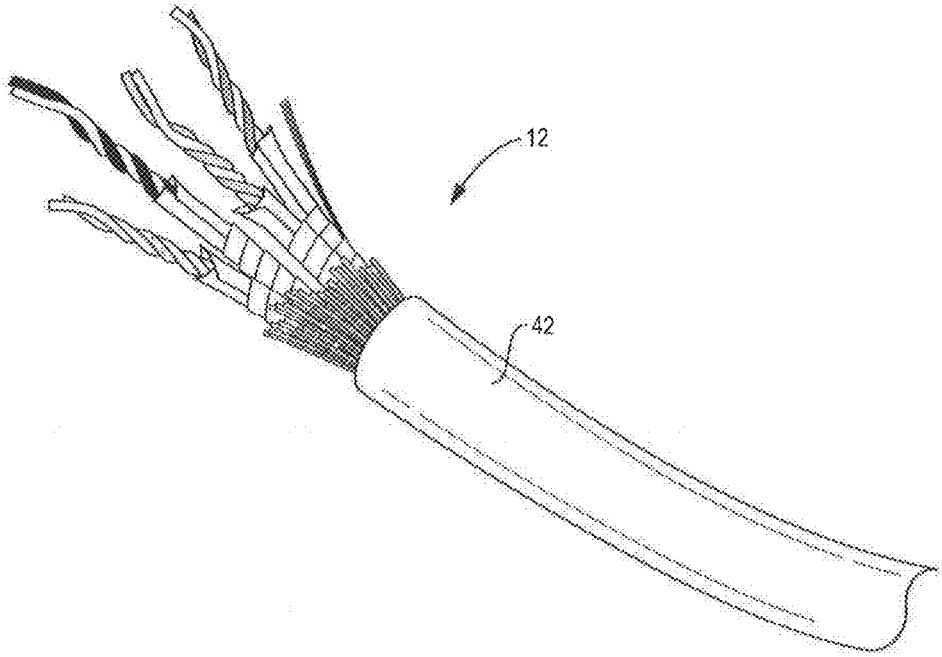
FIG. 16 is a diagrammatic illustration showing an embodiment in which each one of the four twisted pairs is immobilized and shielded by first and second metallic wraps and encased within an exterior jacket to form an improved cable according to the present disclosure.

Turning now to FIGS. 10A, 10B, 10C and 10D, one embodiment of the improved cable 12, according to the present invention, is shown. As shown in these Figures, the lay lengths L in a four (4) pair cable 12 (as shown in FIG. 16, for example) which is required to maintain a lay resonance length, between any 2 pairs in the cable 12 that is shorter than ½ the wavelength of the highest frequency of operation of 2 GHz, is as follows:

Lay length—L

Figure 10A:
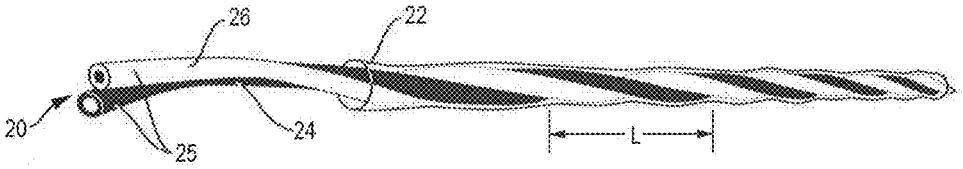
FIGS. 10A, 10B, 10C and 10D are diagrammatic perspective views which show the lay lengths, for a 4 pair cable, which are required to maintain a lay resonance length, between any 2 pairs in the cable that is shorter than ½ the wavelength of the highest frequency of operation of 2 GHz.
Figure 10B:
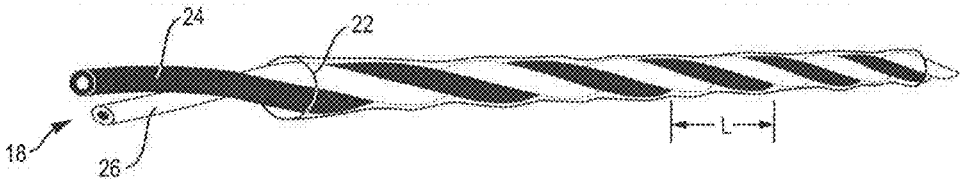
Figure 10C:
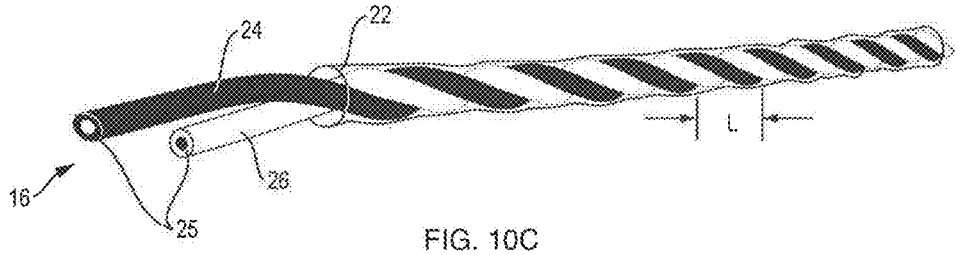
Figure 10D:
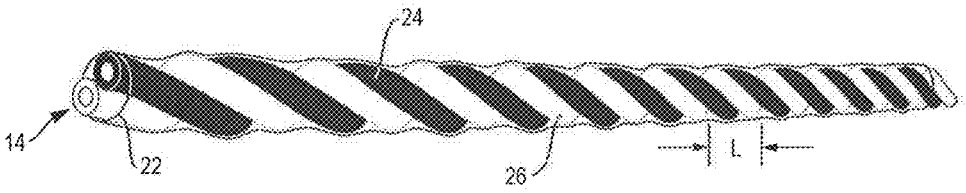

The First Pair (14) 0.35 inches (see FIG. 10D);

The Second Pair (16) 0.43 inches (see FIG. 10C);

The Third Pair (18) 0.6 inches (see FIG. 10B); and

The Fourth Pair (20) 0.9 inches (see FIG. 10A).

When comparing the lay lengths L of any two pairs 14, 16, 18 or 20 of the cable 12 in order to determine the resonance length, the percentage difference between the two pairs 14, 16, 18 or 20 becomes larger as the absolute value of the pair lay lengths L increase. For the two twisted pairs with the shorter lay length, e.g., the first and the second twisted pairs 14 and 16, a percentage difference of only about 23% is required to ensure a short enough resonance length, e.g., the second pair 16 has a lay length L of 0.43 inches which is between about 15 and about 30%, typically about 23%, greater than the lay length L of 0.35 inches of the first pair 14. However, for controlling the resonance length of the long pairs, a percentage difference of between about 30 and about 45%, typically about 40%, is required, since the lay lengths L start from a larger value, e.g., the third pair 18 has a lay length L of 0.6 inches which is about 30 and about 45%, typically about 40%, greater than the lay length L of 0.43 inches for the second pair 16, while a percentage difference of between about 45 and about 60%, typically about 50%, is required between the third and the fourth pairs 18 and 20, e.g., the fourth pair 20 has a lay length L of 0.9 inches which is 50% longer than the lay length L of 0.6 inches for the third pair 18.

According to the present invention, the percentage difference of the lay length L of the (second) twisted pair 16, with the second shortest lay length, and the lay length L of the (first) twisted pair 14, with the shortest lay length, is between about 10-25%. The percentage difference of the lay length L of the (third) twisted pair 18, with the second longest lay length, and the lay length L of the (second) twisted pair 16, with the second shortest lay length L, is between about 25-45%. The percentage difference of the lay length L of the (fourth) twisted pair 20 with the longest lay length and the lay length L of the (third) twisted pair 18 with the second longest lay length is between about 45-70%.

It is to be appreciated that the four (4) lay lengths L, in a four (4) pair cable 12, are not established by equally dividing up the differences in lay lengths L among the four (4) twisted pairs 14, 16, 18 or 20 of the cable 12, or equally dividing the ratio of the longest and shortest pair lay lengths L among the four (4) twisted pairs 14, 16, 18 or 20 of the cable 12, or an empirically established sequencing of the lay lengths within the cable 12 within conventional bounds of maximum and minimum lay lengths. A fundamental requirement is to place bounds on the resonance length between any two twisted pairs 14, 16, 18 or 20 of the four (4) pair cable 12.

For a cable 12 with non-shielded pairs, it is important that no combination of twisted pairs within the cable 12 have a resonance length longer than about 2 inches, which is about % wavelength of the highest frequency of operation for the frequency range of the cable 12, namely, 2 GHz for the cable 12 according to the present invention.

It is to borne in mind that this wide range of lay lengths L and the different path lengths induced by spiral of the wires in the twisted pair 14, 16, 18 or 20, at those different lay lengths L, adds problems in maintaining the twisted pair 14, 16, 18 or 20 to twisted pair 14, 16, 18 or 20 signal propagation delay, as required by the applicable standards.

A first technique for addressing the signal propagation delays of the various twisted pairs 14, 16, 18 or 20 is to encase or surround each of the first and the second conductors 24, 26, which form one of the twisted pairs 14, 16, 18 or 20, in an appropriate conductor insulation 25. For example, at least the first and the second conductors 24, 26 which are to be twisted together in order to form the twisted pair which has the shortest lay length, e.g., the first twisted pair 14 as shown in FIG. 10D, or to form the twisted pair which has the second shortest lay length, e.g., the second twisted pair 16 as shown in FIG. 10C, are encased or surrounded by a conductor insulation 25 which has a relatively low dielectric constant material (e.g., having a dielectric constant of about 1.5, for example), such as a foamed insulation, while the first and the second conductors 24, 26 which are to be twisted together in order to form the twisted pair which has the longest lay length, e.g., the fourth twisted pair 20 as shown in FIG. 10A, or to form the twisted pair which has the second longest lay length, e.g., the third twisted pair 18 as shown in FIG. 10B, are encased or surrounded by a conductor insulation 25 which has a relatively high dielectric constant material (e.g., having a dielectric constant of about 4.0, for example), such as a solid insulation.

By appropriate selection of the dielectric material or wrap 22 for forming the conductor insulation 25, which surrounds and/or encases each of the first and the second conductors 24, 26 that form each twisted pair 14, 16, 18 or 20, the propagation delay differences of the various twisted pairs 14, 16, 18 or 20, which have different lay lengths L, can be easily readily and easily compensation for so that any electric signal, which travels along each one of the twisted pairs 14, 16, 18 or 20, will generally have the same propagation velocity.

In order to compensate further for the propagation delay differences of the various twisted pairs 14, 16, 18 or 20, which have different lay lengths L, the conductors 24, 26 of at least the longest lay length (fourth) twisted pair 20 or possibly, the conductors 24, 26 of both of the two longest lay length (third and fourth) twisted pairs 18, 20 are wrapped together by a dielectric layer (e.g., a polyester film) or wrap 22 as shown in FIGS. 10B and 10A, while the first and the second conductors 24, 26 of at least the shortest lay length (first) twisted pair 14 or possibly, the first and the second conductors 24, 26 of both of the two shortest lay length (first and second) twisted pairs 14, 16 may, or may not, be wrapped together by any dielectric layer (e.g., a polyester film) or wrap 22. It is to be appreciated by choosing the desired dielectric layers or wraps 22, for wrapping both of the conductors 24, 26 of the twisted pair 20, 18, 16 or 14 together, further compensation of the propagation delay differences between the twisted pairs can be achieved.

That is, the dielectric layers or wraps 22 which have a relatively low dielectric constant, for example, are appropriate materials for wrapping or otherwise binding the two insulated conductors 24, 26 of the first and the second twisted pairs 14, 16—and possibly the third twisted pair 18—with one another in order to assist with maintaining the mechanical strength and integrity of the respective twisted pairs, during subsequent handing and manufacture thereof, while also assisting with increasing the velocity of signals traveling along the insulated conductors 24, 26 of those twisted pairs 14, 16 or 18. For the longer lay lengths L, the dielectric layers or wraps 22 which have a relatively high dielectric constant are appropriate materials for wrapping or otherwise binding the two insulated conductors 24, 26 of the third and the fourth twisted pairs 20, 18—and possibly the second twisted pair 16—with one another to assist with maintaining the mechanical strength and integrity of the twisted pairs 20, 18 or 16, during subsequent handing and manufacture thereof, and also assist with decreasing the velocity of any electrical signal(s) traveling along the insulated conductors 24, 26 of those twisted pairs 20, 18 or 16.

Figure 11:
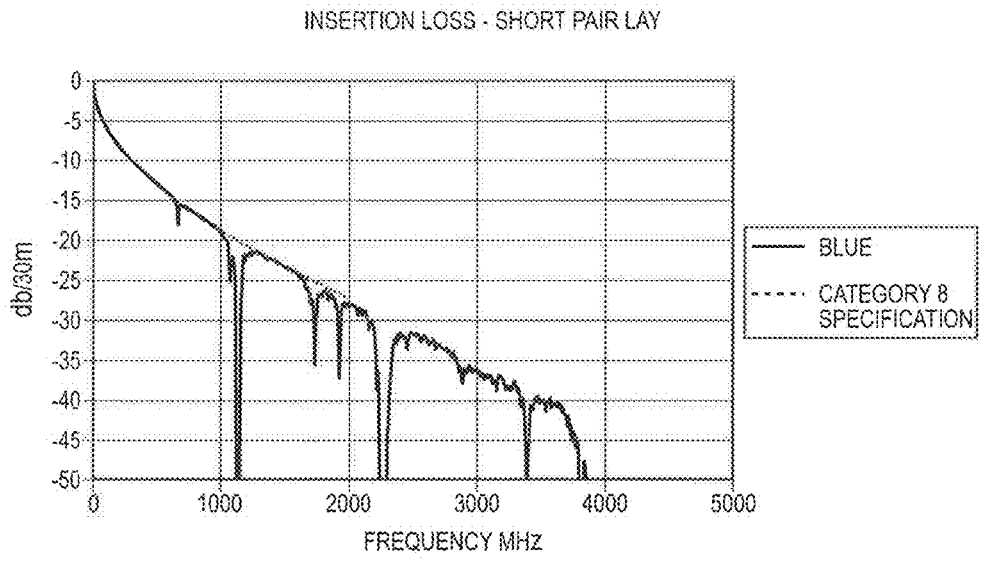
FIGS. 11 and 12 show results from one cable showing the difference in the insertion loss curve with a relatively short and a relatively long lay length.
Figure 12:
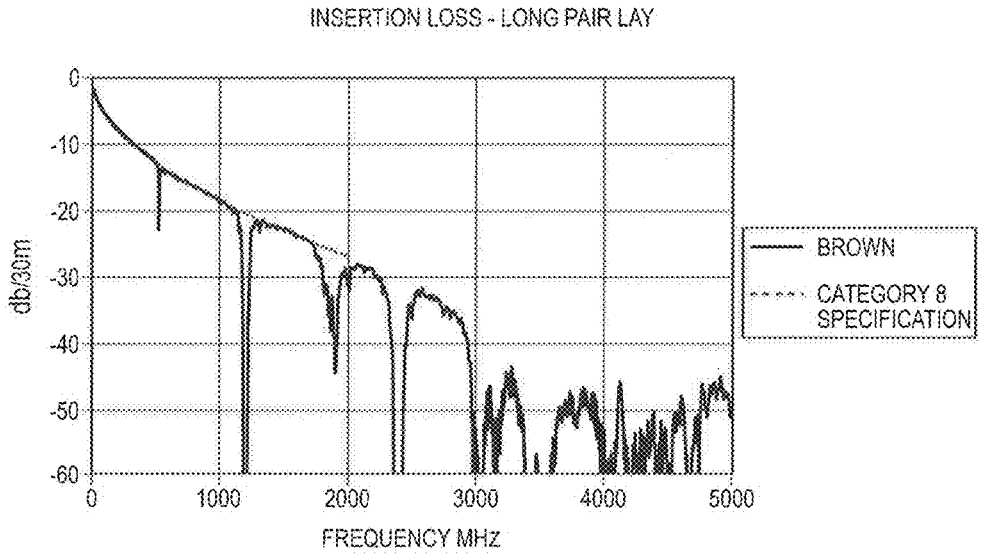

FIG. 11 shows an insertion loss curve for a cable 12 with a relatively short lay length L while FIG. 12 shows an insertion loss curve for a cable 12 with a relatively long lay length. This particular cable 12 is not optimized in other ways for such high frequency operation, and has structure in the insertion loss curves in addition to the lay length effect. The rapid increase in insertion loss at about 4 GHz, for the (first) twisted pair 14 with the shorter lay length, and 3 GHz, for the (fourth) twisted pair 20 with the longer lay length, is due to the interaction of the non-shielded pairs with the overall shield when the pair lay is about the electrical wavelength.

This observation is important because the lay lengths L, needed to control crosstalk resonances, can be relatively long, but the longer lay lengths also have the interaction with the shield which occurs at lower frequencies. It is to be appreciated that both parameters must be suitably controlled, in the cable design, in order to provide a cable 12 which is suitable for use in the 2 GHz region.

A hoop strength of the dielectric layer or wrap 22, which wraps the pair of insulated conductors 24, 26 together with one another, is affected by the stiffness, the thickness, and the spiral length of the layer or wrap. For instance, a wrapping tape applied with a long lay length, e.g., a lay length substantially extending parallel to the longitudinal axis of the twisted pair 14, 16, 18 or 20, or in a generally longitudinal fashion has a hoop strength of essentially zero. It is to appreciated that an adhesive(s) can be used to adhesively bond the overlapped edges of the dielectric layer or wrap 22 with one another and thereby somewhat increase the effective hoop strength of the short or the long lay length wrapping layers or tapes. However, the adhesive layer, bonding the overlapped edges of the dielectric layer or wrap 22 to one another, can reduce, or possibly substantially eliminate, the desired electrical continuity and/or grounding function of the wrapping layer or tape.

For cables that contain pairs with a metallic pair shield, the proximity of the metallic shield to the insulated conductors 24, 26 increases the susceptibility to pertubations caused by the cabling process. For shielded pairs, the hoop strength needs to be greater than that of a non-shielded pair in order to maintain the mechanical integrity and the desired electrical properties of the twisted pair. The hoop strength is defined by the wrap material modulus of elasticity, the thickness of the wrap, the angle at which the wrap is applied and the amounts of wrap overlap. For the purpose of wraps on a cable component, the hoop strength is defined as:

$$HS=M*T*\sin(\ominus)*(1+O)$$

Where HS is the hoop strength in kg/mm,

M is the wrap material modulus of elasticity in kg/mm$^2$,

T is the thickness of the wrap in mm, $\ominus$ is the angle of deviation of the applied wrap spiral from the longitudinal axis of the twisted pair, e.g., 14, 16, 18 or 20, or cable core assembly 44, and O is the overlap of the wrap to account for the portions of the wrap that have double thickness.

As an example, a pair of insulated conductors 24, 26 of a non-shielded pair 14, 16, 18 or 20 may be wrapped with a dielectric layer or wrap 22 with a modulus of elasticity of 500 kg/mm$^2$ and a thickness of 12 microns. The twisted pair 14, 16, 18 or 20, in this example, is wrapped with a short spiral lay length at an angle of 60 degrees relative to the longitudinal axis of the cable 12 with 25% wrap overlap. Based upon the above formula, the resulting hoop strength is calculated to be 500*0.012*0.866*1.25=6.495 kg/mm$^2$. One technique for increase the hoop strength is to use first and second pairs of metallic wraps, with a modulus of elasticity of about 7000 kg/mm$^2$ and a thickness of 25 microns, for wrapping around the twisted pair 14, 16, 18 or 20. The pair of insulated conductors 24, 26 of the twisted pair 14, 16, 18 or 20, in this example, is wrapped longitudinally with a first tape having 25% overlap that provides substantially no hoop strength. The hoop strength of the first tape would be 7000*0.025*0.0*1.25=0 kg/mm$^2$. The second (hoop) wrap is at a relatively short lay length with a 60 degree angle, and a 25% overlap. The hoop strength of second (hoop) wrap, in this example, is 7000*0.025*0.866*1.25=189.5 kg/mm$^2$.

It is to appreciated that a typically tape surrounding a pair does not sufficiently control the twisted pairs 14, 16, 18 or 20 or the cable 12 to prevent the electrical performance anomalies. That is, a (hoop) tape or wrap must be sufficiently tightly wrapped around and/or over the two insulated conductors 24, 26 of the twisted pair 14, 16, 18 or 20, or the cable core assembly 44, in order to provide the desired mechanical strength and integrity. The 'tightness' of the wrapping, over the two insulated conductors 24, 26 of the twisted pairs 14, 16, 18 or 20, is defined as the 'extra circumference' of the wrap compared to the combined circumference of two insulated conductors 24, 26 or wrapped components.

Figure 13:
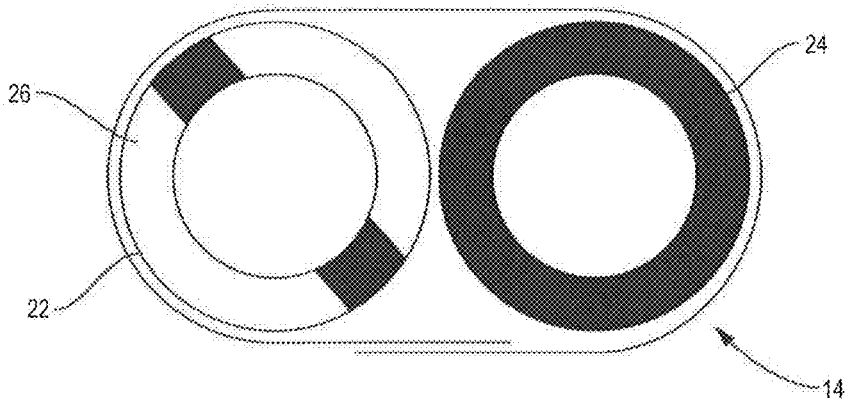
FIG. 13 diagrammatically illustrates a dielectric pair minimum circumference for a dielectric wrap which completely circumscribes two insulated conductors.

For a dielectric layer or wrap 22, a "dielectric pair minimum circumference" is defined as the shortest perimeter distance in order for the layer or wrap 22 to completely circumscribe both of the two insulated conductors 24, 26 when they are in abutting engagement with one another, i.e., as generally shown by the wrap 22 in FIG. 13, the dielectric pair minimum circumference is oval shaped and wraps around both of the two insulated conductors 24, 26. The wrap circumference for the pair should assure a tight wrap for maintaining electrical performance of the cable 12. The circumference of the wrap, for wrapping the two insulated conductors 24, 26 of the twisted pair 14, 16, 18 or 20 according to the present disclosure, should be no more than about 5% greater than the dielectric pair minimum circumference at any point along the length of the twisted pair 14, 16, 18 or 20. That is, the circumference of the wrap should typically range between 0.0% and 5.0% greater than the dielectric pair minimum circumference of the two insulated conductors 24, 26 so that the wrap constantly and continuously maintains the mechanical strength and integrity of the insulated conductors 24, 26 of the twisted pair 14, 16, 18 or 20 and thus prevents the two insulated conductors 24, 26 from becoming sufficiently separated or spaced apart from one another during subsequent handling and/or installation of the cable 12. It is to be appreciated that the dielectric pair wrap circumference includes any previous application of a dielectric wrap(s) or inner layer of a long lay metallic wrap 30.

According to the present invention, at least the two insulated conductors 24, 26 of the (fourth) twisted pair 20 with the longest lay length L is bound, wrapped or otherwise immobilized with a dielectric (hoop) layer or wrap 22 so as to prevent, or significantly minimize at the very least, relative movement of the two conductors 24, 26 with respect to one another. If a dielectric layer or wrap 22 is utilized for immobilizing the (fourth) twisted pair 20 with the longest lay length L, then the two insulated conductors 24, 26 of the (third) twisted pair 18 for the second longest lay length may also be bound, wrapped or otherwise immobilized with a dielectric (hoop) layer or wrap 22 so as prevent, or significantly minimize at the very least, relative movement of the two conductors 24, 26 of the (third) twisted pair 18 with the second longest lay length with respect to one another.

For some applications, the two insulated conductors 24, 26 of the (second) twisted pair 16 with the second shortest lay length may also bound, wrapped or otherwise immobilized with a dielectric (hoop) layer or wrap 22 so as prevent, or significantly minimize at the very least, relative movement of the two conductors 24, 26 of the (second) twisted pair 16 with the second shortest lay length with respect to one another. The two insulated conductors 24, 26 of the (first) twisted pair 14 with the shortest lay length may also bound, wrapped or otherwise immobilized with a dielectric (hoop) layer or wrap 22 so as prevent, or significantly minimize at the very least, relative movement of the two conductors 24, 26 of the (first) twisted pair 14 with the shortest lay length with respect to one another.

Figure 14:
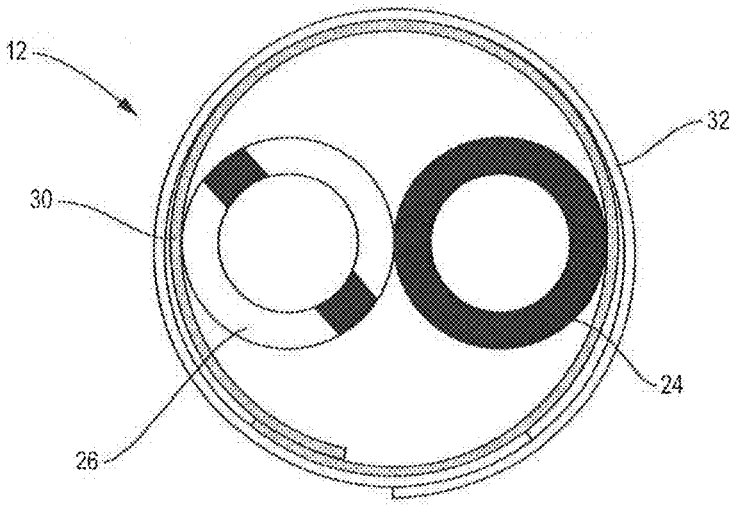
FIG. 14 diagrammatically illustrates a metallic pair minimum circumference for a pair of metallic wraps which both completely circumscribe two insulated conductors.
Figure 15A:
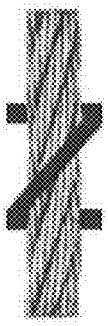
FIGS. 15A-15D diagrammatically illustrate S and Z cabling to minimize the further twisting or mechanical deformations of the twisted pairs.
Figure 15B:
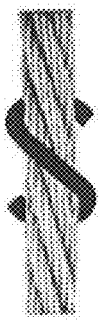
Figure 15C:
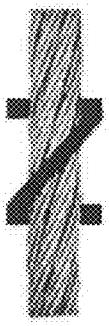
Figure 15D:
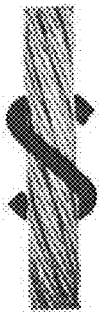

With respect to the previous embodiment in which each one of the twisted pairs 14, 16, 18 or 20 is wrapped with first and second metallic wraps 30, 32, the inventors have discovered that according to this embodiment the lay lengths for each of the twisted pairs 14, 16, 18 or 20 do not have to vary greatly from one another. For example, the inventors have discovered that percentage difference of the lay length L of the (second) twisted pair 16, with the second shortest lay length, only has to be at least 3-4% greater than the lay length L of the (first) twisted pair 14, with the shortest lay length. The percentage difference of the lay length L of the (third) twisted pair 18, with the second longest lay length, only has to be at least 3-4% greater than the lay length L of the (second) twisted pair 16, with the second shortest lay length L. The percentage difference of the lay length L of the (fourth) twisted pair 20, with the longest lay length, only has to be at least 3-4% greater that the lay length L of the (third) twisted pair 18, with the second longest lay length. For the metallic wraps 30, 32, a "metallic pair minimum circumference" is defined as the shortest perimeter distance in order to completely circularly circumscribe both of the two insulated conductors 24, 26 when they are in abutting engagement with one another, i.e., the metallic pair minimum circumference is circular shaped, as generally shown in FIG. 14 by the first and second wraps 30, 32 which both circumscribe and wrap around the two insulated conductors 24, 26.

The wrap circumference of the metallic pair should assure a tight wrap for maintaining electrical performance of the twisted pair. The wrap circumference of the first and the second wraps 30, 32, for wrapping the two insulated conductors 24, 26 of the twisted pair 14, 16, 18 or 20 according to the present disclosure, should be no greater than the metallic pair minimum circumference of the twisted pair 14, 16, 18 or 20. That is, the circumference of the wrap should be no greater than the metallic pair minimum circumference of the two insulated conductors 24, 26 so that the wrap maintains the mechanical strength and integrity of the insulated conductors 24, 26 of the twisted pair 14, 16, 18 or 20 and prevents the two insulated conductors 24, 26 from becoming sufficiently separated or spaced apart from one another during subsequent manufacture, handing, installation and/or use of the cable 12. It is to be appreciated that the metallic pair wrap circumference includes any previous application of a dielectric wrap(s) or inner layer of a long lay metallic wrap 30.

A suitable dielectric layer or wrap 22, which is utilized for wrapping the third and the fourth twisted pairs 18 or 20 having the longer lay lengths, may be, for example, a solid material while the dielectric layer or wrap 22, utilized for wrapping the first and the second twisted pairs 14 or 16 having the two short lay lengths, may be, for example, a foamed material.

It is to be appreciated that each of the two conductors 24, 26 may be first individually pre-twisted, in a conventional manner, to have a desired pretwist prior to the two conductors 24, 26 being twisted with one another to form a twisted pair 14, 16, 18 or 20. Next, both of the pretwisted conductors 24, 26 are then surrounded and encased with a suitable conductor insulation 25 in a conventional manner. Thereafter, the two conductors 24, 26, which have been encased within the suitable conductor insulation 25, are then finally twisted with one another to form a twisted pair which has a desired lay length L and then wrapped with a dielectric layer or wrap 22 (see FIGS. 10A-10D). The dielectric layer or wrap 22 maintains the first and the second insulated conductors 24, 26 in intimate contact and engagement with one another, during subsequent handling of the twisted pair 14, 16, 18 or 20, so as to maintain the mechanical strength and integrity of the insulated conductors 24, 26 of the twisted pair 14, 16, 18 or 20.

It is to be appreciated that the dielectric layer or wrap 22 also assists with straightening of the first and the second insulated conductors 24, 26 and compensates for spiraling which is induced into the first and the second insulated conductors 24, 26, during twisting, to form the twisted pair 14, 16, 18 or 20. The inventors have discovered that the above benefits are only achieved in the event that the dielectric layer or wrap 22 has a length around the first and the second insulated conductors 24, 26 which does not exceed the dielectric pair minimum circumference around the twisted pair 14, 16, 18 or 20 of the cable 12 by more than 5%. That is, the circumference of the wrap should be between 100.0% and 105.0% of the dielectric pair minimum circumference in order to maintain the mechanical strength and integrity of the insulated conductors 24, 26 of the twisted pair 14, 16, 18 or 20 and prevent the two insulated conductors 24, 26 from becoming sufficiently separated or spaced apart from one another during subsequent manufacture, handing and/or installation of the cable 12.

According to another embodiment, the hoop wrap which maintains the first and the second insulated conductors 24, 26 in intimate contact and engagement with one another, during subsequent manufacture, handing and/or installation of the twisted pair 14, 16, 18 or 20, is a dielectric material.

Cable Core Wrap

Figure 17A:
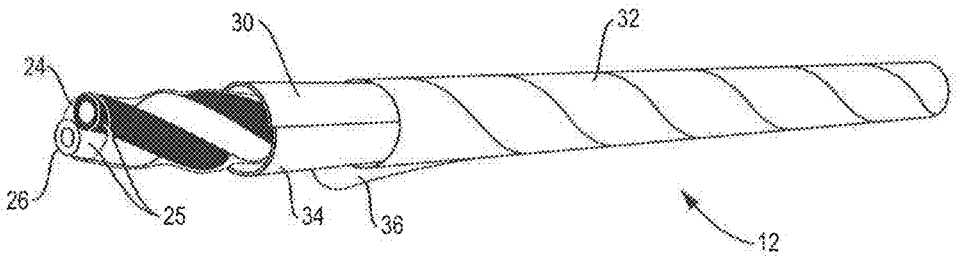
FIG. 17A diagrammatically illustrates a pair of insulated conductors which are wrapped with both a first metallic layer, having a long lay length, and a second metallic layer, having a short length.
Figure 17B:
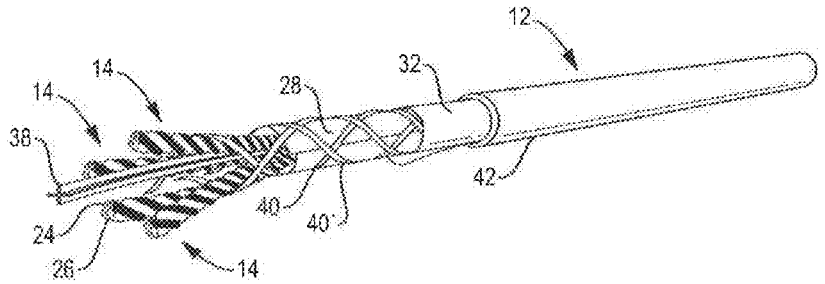
FIG. 17B is a diagrammatic drawing showing an embodiment in which each one of the four twisted pairs is immobilized with the dielectric material and shielded by a metallic layer and encased with an exterior jacket to form an improved cable according to the present disclosure.

It is to appreciated that for cables 12 with non-shielded pairs 14, 16, 18 or 20, control of the position of the pairs 14, 16, 18 or 20, within the cable assembly, is important. Periodic variations in the spacing, from the twist pair 14, 16, 18 or 20 to the surrounding shield, can cause electrical anomalies, and the process of cabling pairs together can cause periodic dimensional variations to occur. A dielectric core wrap 28 can be applied over the four twisted pairs 14, 16, 18 or 20 and under a surrounding metal shield layer, as shown in FIG. 17B, in order to control the spacing of the four twisted pairs 14, 16, 18 or 20 relative to one another. An appropriate wrap is one with a hoop strength of about 12 $kg/mm^2$ or more and a circumference no greater than 5% the dielectric pair minimum circumference of the two wrapped insulated conductors 24, 26. In addition, a centrally located "+-shaped" spacer 38 along with the first, the second, the third, and the fourth twisted pairs 14, 16, 18 or 20 and the dielectric core wrap 28 are all bound together with one another by at least one adhesive band or filament 40 which is wrapped in a helical fashion or manner so as to surround and secure all of those components together. More preferably, a second adhesive band or filament 40' also wraps around those components, in an opposite helical direction to the first adhesive band or filament 40, and the first and the second adhesive bands or filaments 40, 40' assist with further maintaining the structural integrity of those components during subsequent manufacture, handling, installation and/or use of the cable 12. Lastly, a conventional exterior cover or jacket 42 surrounds and encases all the components together to form the cable 12.

Figure 17C:
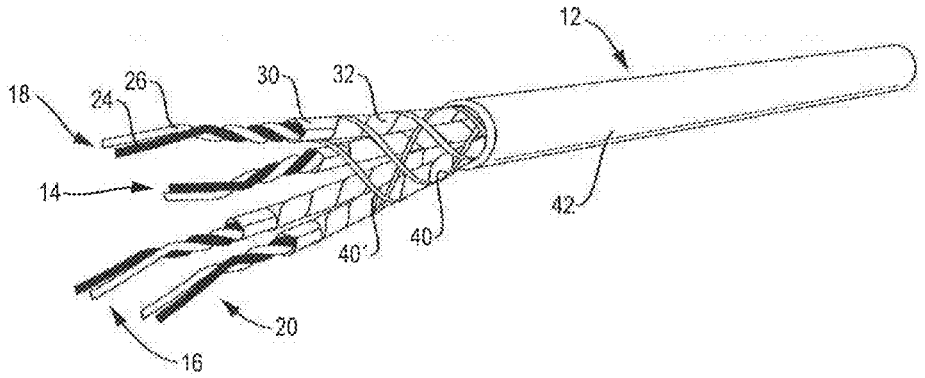
FIG. 17C is a diagrammatic drawing showing an embodiment in which each one of the four twisted pairs is immobilized and shielded by first and second metallic wraps, and all of the twisted pairs are wrapped with binder threads and encased within an outer cover to form an improved cable according to the present disclosure.

In the event that the (fourth) twisted pair 20 with the longest lay length L is bound, wrapped or otherwise immobilized with a metallic layer, then, according to another embodiment of the present invention, each one of the first, the second, the third and the fourth twisted pairs 14, 16, 18 and 20 are also wrapped with both first and second metallic layers 30, 32, as shown in FIG. 17C. According to this embodiment, a respective first layer 30 of a metallic shield tape is wrapped around each one of twisted pairs 14, 16, 18 or 20 so that the first layer or tape 30 has a very long lay length, e.g., the lay length L of the first layer 30 is between a few inches and infinity, as generally shown in FIG. 17A. The first layer 30 is wrapped so that at least a metallic surface 34, of the first layer 30 faces outwardly and away from the two insulated conductors 24, 26 of the twisted pair 14, 16, 18 or 20. The second layer 32 is then wrapped around and surrounds the first layer 30 and both of the two insulated conductors 24, 26 of the twisted pair 14, 16, 18 or 20 so that the metallic side 36 of the second layer 32 faces inwardly toward the metallic side 34 of the first layer 30, as shown in FIG. 17A. The inwardly and outwardly facing metallic surfaces 34, 36 of the first and the second layers 30, 32 directly engage and contact one another so as to provide good electrical contact between those mating metallic surfaces along the entire length of each one of the twisted pairs 14, 16, 18 or 20, thereby providing reliable shielding and grounding of each of the wrapped twisted pair 14, 16, 18 or 20.

Figure 17D:
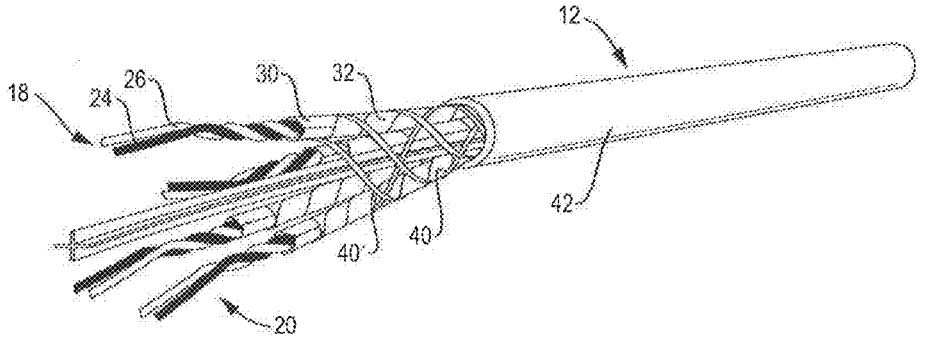
FIG. 17D is a diagrammatic drawing showing an embodiment in which each one of the four twisted pairs is immobilized and shielded by first and second metallic wraps, the four twisted pairs and a central spacer are all wrapped with binder threads and encased within an outer cover to form an improved cable according to the present disclosure.

According to this embodiment, each one of the first, the second, the third and the fourth twisted pairs 14, 16, 18 or 20 is similarly wrapped with first and second layers 30, 32 of a metallic shield tape, as generally shown in FIGS. 16, 17C and 17D. The primary difference between FIGS. 17C and 17D is that FIG. 17D includes a centrally located+-shaped spacer 38, which assists with separating and spacing each one of the first, the second, the third and the fourth twisted pairs 14, 16, 18 or 20 from one another, while FIG. 17C does not include any such spacer. In all other respects, both these embodiments are substantially identical to one another.

As noted above, the metallic spiral shield wrap construction over a twisted pair alone was not found to provide the necessary shielding effectiveness from pair to pair. It was discovered that a combination shield, e.g., both the first and the second metal wraps or layers 30, 32 (with the outer layer 32 being a hoop wrap), may be employed such that a second metallic tape wrap 32, with a shorter lay length, is applied over a first metallic tape or wrap 30, with a long lay length L which generally extends in a longitudinal direction along the twisted pair (see FIG. 17A). It is important to note that the conductive surface 34 of the inner first metallic tape 30, with the longer lay length, faces outwardly and away from the two insulated conductors 24, 26 of the twisted pair 14, 16, 18 or 20 while the conductive surface 36 of the outer second metallic tape or wrap 32, with the shorter lay length, faces inwardly toward the first metallic tape or wrap 32. This configuration establishes good electrical contact between the outwardly and the inwardly facing metallic surfaces 34, 36 with one another of each twisted pair 14, 16, 18 or 20 in the assembled cable 12.

For the core and pair dielectric wraps 22, it is entirely possible and conceivable that a number of filaments may be used in place of a tape to achieve a substantially equivalent hoop strength as the hoop tape or wrap. As an alternate, the metallic overall shield can be applied over the cable core assembly 44 with a hoop strength of about 175 kg/mm$^2$ or more and a circumference no greater than 5% of the dielectric pair minimum circumference of the two wrapped insulated conductors 24, 26.

For either non-shielded pairs or shielded pairs 14, 16, 18 or 20, a dielectric layer or wrap may be directly applied over the insulated conductors 24, 26 but underneath the wrapping layer of the twisted pair. For non-shielded pairs 14, 16, 18 or 20, a dielectric hoop layer or wrap 22 applied over the cable core assembly 44 of wrapped pairs 14, 16, 18 or 20 may also be included to provide some additional physical separation of the twisted pairs 14, 16, 18 or 20 to the overall metallic shield.

Variable Lay and Wrap Lengths

The prior art includes randomizing of the cable lay lengths to minimize crosstalk, from cable 12 to cable 12 as well as the crosstalk from twisted pair 14, 16, 18 or 20 to twisted pair 14, 16, 18 or 20. However, it was discovered that the interaction of the pair lay and the lay of the first and the second tapes or wraps 30, 32 also results in variations in electrical performance at specific frequencies or within frequency ranges. The interaction of the twisted pair 14, 16, 18 or 20 and the pair wrap can be minimized by randomizing at least one of the pair lay length and/or the lay length of the tape or wrap. It has been found that randomizing the lay length of the tape or wrap by about 5 to 20% over lengths from 2 to 8 meters, for example, minimizes those variations in the twisted pair 14, 16, 18 or 20 to shield interaction.

As generally shown in FIGS. 15A-15D, rigid SZ and planetary cabling can be employed to minimize the further twisting or mechanical deformations of the twisted pairs 14, 16, 18 or 20. The pair wrap technique has been successful with SZ, planetary, and conventional (rigid) type cables 12. However, with a wrapped twisted pair 14, 16, 18 or 20, it is desirable to prevent further tightening or loosening of the pair wrap that can be induced by further rotation of the pair 14, 16, 18 or 20 in a conventional (rigid) type of cabling operation. The SZ type of cabling provides a cable 12 that alternates in the lay direction from "S" to "Z." The SZ stranding action also tends to not induce twisting of the cabled elements on their axis. Some inherent randomization of the cable lay length along the cable 12, due to a reversal in the cabling direction, occurs during the cabling process, as there is a very short section of cable 12 between the reversals that has no (or infinite) lay length.

As described above, the operation of twisting a group of pairs causes periodic deformations in the core that result in electrical performance problems of insertion loss notches and return loss spikes. Because of the frequency of operation that extends to 2 GHz or more, the twist length (e.g., lay length of the core) must be on the order of 2 inches or less. Such a short lay length causes excess length due to the spiral, resulting in excessive insertion loss and electrical delay.

The inventors have discovered that the frequency of the electrical defects is not related to the actual lay length of the cable core assembly 44, but due to the periodicity of the deformations which occur while initially forming the twisted cable core assembly 44. More importantly, if the cable core assembly 44 is re-twisted to result in a second cable core assembly lay length, the defects and the frequency of the defects from the first cabling action of the cable core assembly 44 still generally remain.

Figure 18:
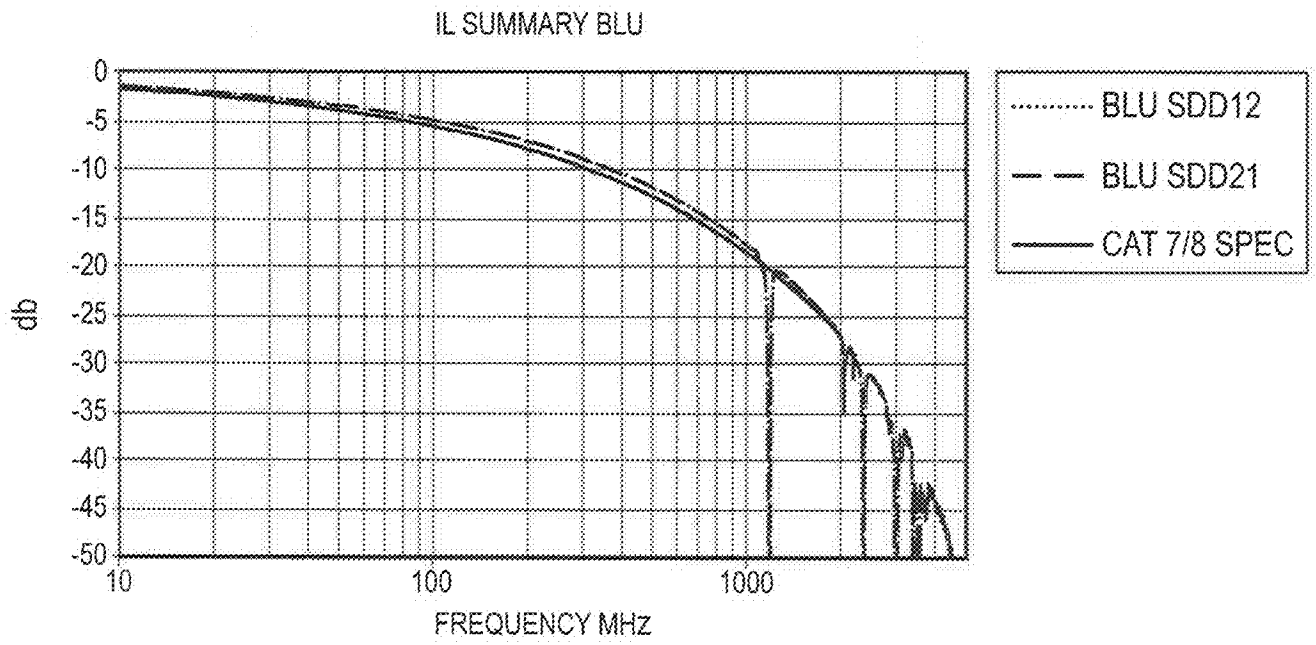
FIG. 18 is a plot showing insertion loss versus frequency for a cable that was subjected to two cabling operations.

FIG. 18 is a diagram showing insertion loss versus frequency for a cable 12 that was subjected to an initial first cabling operation and then subjected to a second cabling operation. It is to appreciated that the cable core assembly 44 of this cable 12 was first assembled and cabled to have a cable lay length of about 3.75 inches. This lay length corresponds to the electrical wavelength at a frequency of about 1.1 GHz. Thereafter, the same cable 12 was then "re-cabled" in the opposite direction, which resulted in a net lay length of the cable core assembly 44 of about 6 inches. That is, the cable core assembly 44 of the cable 12 was subjected to a second cabling operation, in the reverse or opposite cabling direction, which loosen the twist of the cable core assembly 44 and thereby increase the overall net lay length of the cable core assembly 44 to about 6 inches in an attempt to minimize, during the second cabling operation, the effect of mechanical perturbations.

According to one embodiment, the cable core assembly 44 may be optionally reinforced with at least one of a cable core assembly wrap 22 and a cable core assembly reinforcing layer 40, 40' before the second recabling operation occurs. Most importantly, this chart shows that the insertion loss notch at about 1.1 GHz is generally caused by the initial first cabling operation at the lay length of the first cabling operation. Moreover, this example also shows that the periodic perturbations of about 3.75 inches along the length of cable 12 still remain in the cable 12, even though the actual lay length of the cable core assembly 44 is now longer, e.g., about 6 inches in this instance, as a result of the second cabling operation.

The above demonstrates that the insertion loss notches are a function of the perturbation length periodicity, and not the physical lay length of the twisted pairs 14, 16, 18 or 20 or components of the cable core assembly 44 following the final cabling operation for the cable 12. Such multiple cabling operation may be performed in order to optimize the electrical frequency of the insertion loss notch as well as other attributes of the cable 12 such as overall insertion loss that can be improved by having longer physical cable lay lengths.

One approach that is directed at solving the above noted problem is to first cable the cable core assembly 44 at a lay length of about 2 inches or less, for example, in a first cabling direction so that such lay length imparts the electrical problems at frequencies above the range of interest of about 2 GHz. Thereafter, the cable core assembly 44 is then optional provided with an additional (hoop) layer or wrap 22 which provides additional mechanical strength and integrity to the cable core assembly 44. However, due to the very tight twisting action of the cable core assembly 44 at a lay length of about 2 inches, as noted above this cable core assembly 44 still has the problems of electrical insertion loss, electrical delay and possibly some crushing of the components. The additional hoop wrap or layer 22 may comprise a dielectric yarn or tape so that the pitch of the additional wrap or layer 22 is longer than the width of the additional wrap or layer. This allows the metal of the pair metal shield tapes to be exposed to layers that are applied over the wrapping.

Next, the cable core assembly 44 is then re-cabled in a second opposite direction, which results in a longer net lay length of the cable core assembly 44, e.g., a lay length of 6 inches for example, thereby reducing the helical length and improving both the insertion loss and the electrical delay. Such re-cabling may also relax/reduce the crushing effect of the twisted pair(s) 14, 16, 18 or 20 with the short cable lay length(s), further improving the insertion loss of the cable. The improved mechanical strength and integrity of the cable core assembly 44, compared to the individual twisted pairs 14, 16, 18 or 20 within the cable 12, eliminates, or generally minimizes, the effects on the electrical properties due to the second cabling operation.

Because this second cabling/twisting operation is at a longer twist rate, it is also possible that reinforcement of the cable core assembly 44 may be necessary. In addition, at longer twist rates, the mechanical deformation forces induced by the manufacturing equipment are generally less severe.

Example of a Cable Construction

Figure 19A:
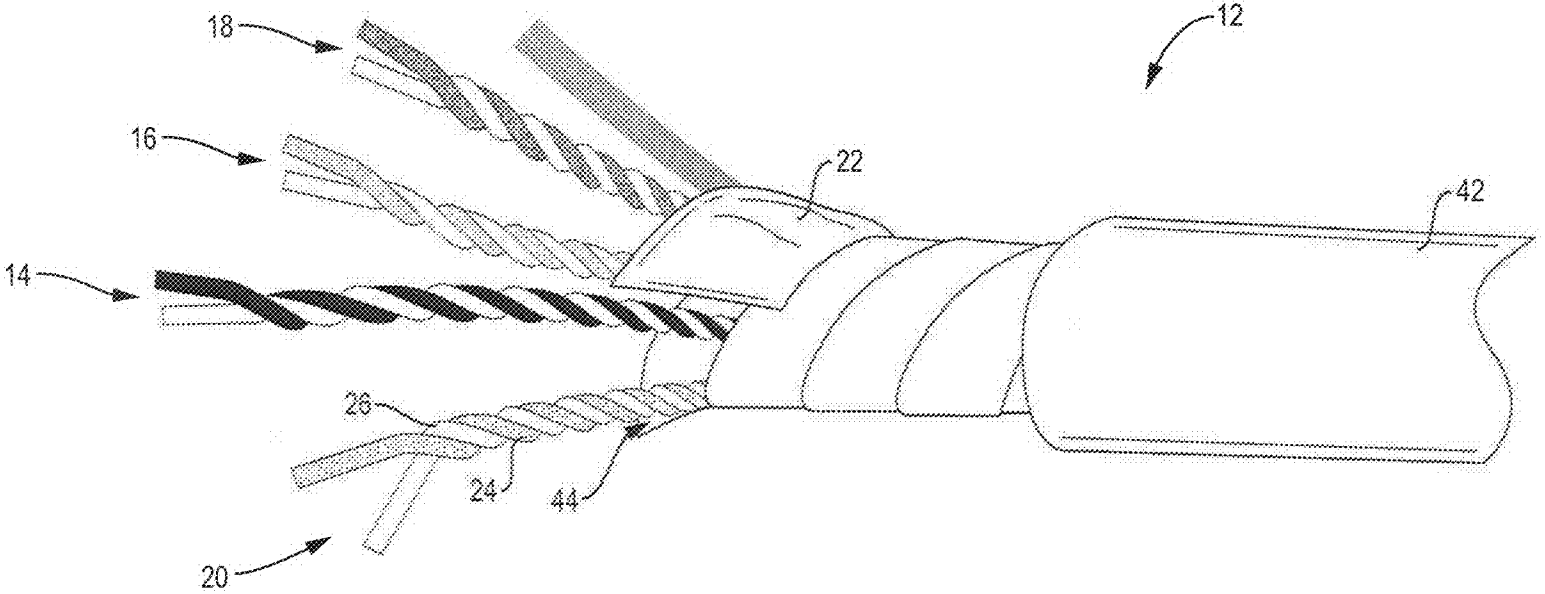
FIG. 19A is a diagrammatic illustration showing an embodiment in which four twisted pairs are assembled with one another in a linear cable core assembly and thereafter wrapped with a metallic hoop wrap in order to shield, immobilized and bind each one of the twisted pairs with one another and prevent separation of the respective first and the second insulated conductors, of each of the twisted pairs, from one another during subsequent manufacture and handling of the cable.

A first example, according with the above described embodiment, is shown in FIG. 19A and discussed below in further detail. According to this embodiment, a plurality of twisted pairs, e.g., four twisted pairs 14, 16, 18 or 20 in this instance, are assembled with one another in order to form a cable core assembly 44 which is substantially linear. That is, a longitudinal axis of each one of the twisted pairs 14, 16, 18 or 20 of the cable core assembly 44 extends substantially parallel to one another. While the twisted pairs 14, 16, 18 or 20 of the cable core assembly 44 are arranged parallel to one another, the cable core assembly 44 is then wrapped with a metallic hoop wrap 22 in order to immobilized and bind all of the plurality of twisted pairs 14, 16, 18 or 20 with one another and prevent the respective first and the second insulated conductors 24, 26, of each one of the twisted pairs 14, 16, 18 or 20, from one separating from one another during subsequent manufacture and handling of the cable 12. The metallic hoop wrap 22 also assists with shielding of the plurality of twisted pairs 14, 16, 18 or 20 of the cable core assembly 44.

If desired, one or more adhesive bands or filaments (not shown) may be wrapped around metallic hoop wrap 22, in an opposite helical direction, to assist further with maintaining the structural integrity of those components during subsequent manufacture, handling and installation of the cable 12. Lastly, a conventional exterior cover or jacket 42 surrounds and encases all the components together to form the cable 12.

Figure 19B:
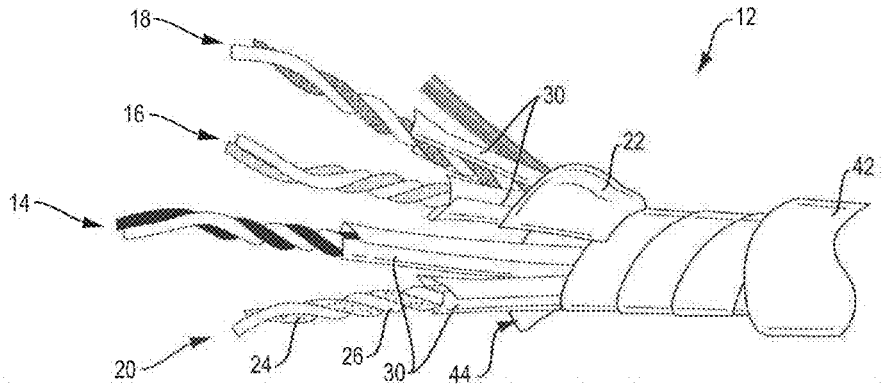
FIG. 19B is a diagrammatic illustration showing an embodiment in which each one of the twisted pairs is first surrounded with a metallic layer or tape which has a lay length extending substantially parallel to a longitudinal axis of the twisted pair and then the metallically surrounded twisted pairs are then assembled with one another in a linear cable core assembly and wrapped with a metallic hoop wrap in order to immobilized and bind the twisted pairs with one another and prevent separation of the respective first and the second insulated conductors, of each of the twisted pairs, from one another during subsequent manufacture and handling of the cable.

FIG. 19B is a diagrammatic drawing showing another embodiment, similar to FIG. 19A, in which each one of the twisted pairs 14, 16, 18 or 20 is first individually surrounded with a metallic layer or tape 30 which has a substantially infinite lay length, i.e., a lay length extending substantially parallel to a longitudinal axis of the twisted pairs 14, 16, 18 or 20. Once each one of the twisted pairs 14, 16, 18 or 20 is individually surrounded with a respective metallic layer or tape 30, the surrounded twisted pairs 14, 16, 18 or 20 are then assembled with one another in order to form a cable core assembly 44 which is substantially linear. That is, a longitudinal axis of each one of the surrounded twisted pairs 14, 16, 18 or 20 of the cable core assembly 44 extends substantially parallel to one another. While the twisted pairs 14, 16, 18 or 20 of the cable core assembly 44 are arranged parallel to one another, the cable core assembly 44 is then wrapped with a metallic hoop wrap 22 in order to immobilized and bind all of the plurality of surrounded twisted pairs 14, 16, 18 or 20 with one another and prevent the respective first and the second insulated conductors 24, 26, of each one of the surrounded twisted pairs 14, 16, 18 or 20, from separating from one another during subsequent manufacture and handling of the cable 12. The metallic hoop wrap 22 also assists with shielding of the plurality of twisted pairs 14, 16, 18 or 20 of the cable core assembly 44.

If desired, one or more adhesive bands or filaments (not shown) may be wrapped around metallic hoop wrap 22, in an opposite helical direction, to assist further with maintaining the structural integrity of those components during subsequent manufacture, handling and installation of the cable 12. Lastly, a conventional exterior cover or jacket 42 surrounds and encases all the components together to form the cable 12.

Figure 19C:
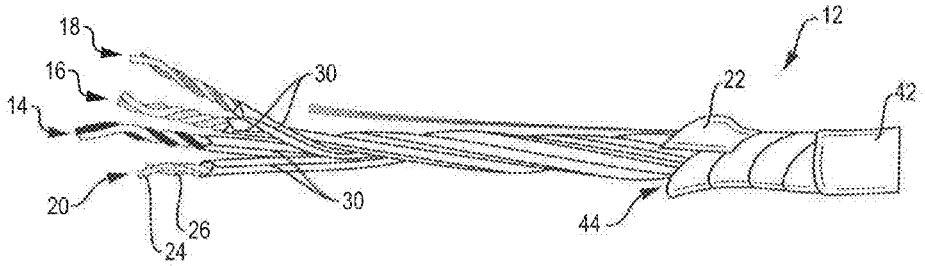
FIG. 19C is a diagrammatic illustration showing an embodiment in which each one of the twisted pairs is first surrounded with a metallic layer or tape which has a lay length extending substantially parallel to a longitudinal axis of the twisted pair and then the surrounded twisted pairs are assembled with one another into a linear cable core assembly which is initially cable to have a cable length of 2 inches or less and thereafter wrapped with a metallic hoop wrap in order to immobilized and bind the twisted pairs with one another and prevent separation of the respective first and the second insulated conductors, of each of the twisted pairs, from one another during recabling of the wrapped cable core assembly and/or subsequent manufacture and handling of the cable.

FIG. 19C is a diagrammatic drawing showing another embodiment, similar to FIG. 19B, in which each one of the twisted pairs 14, 16, 18 or 20 is first individually surrounded with a metallic layer or tape 30 which has a substantially infinite lay length, i.e., a lay length extending substantially parallel to a longitudinal axis of the twisted pair. Once each one of the twisted pairs 14, 16, 18 or 20 is individually surrounded with a respective metallic layer or tape 30, the surrounded twisted pairs are then assembled with one another in order to form a cable core assembly 44 which is substantially linear. That is, a longitudinal axis of each one of the surrounded twisted pairs 14, 16, 18 or 20 of the cable core assembly 44 extends substantially parallel to one another.

Next, the cable core assembly 44 is cabled in a first direction so as to have a lay length of about 2 inches or less, 1.8 inches for example, and such lay length imparts the electrical problems at frequencies above the range of interest of about 2 GHz. Following the initial cabling of the cable core assembly 44, the cable core assembly 44 is then wrapped with a metallic hoop wrap 22 in order to immobilized and bind all of the plurality of surrounded twisted pairs 14, 16, 18 or 20 with one another and prevent the respective first and the second insulated conductors 24, 26, of each one of the surrounded twisted pairs 14, 16, 18 or 20, from separating from one another during subsequent handling, manufacture, installation and use of the cable 12 manufacture and handling of the cable 12. The metallic hoop wrap 22 also assists with shielding of the plurality of twisted pairs 14, 16, 18 or 20 of the cable core assembly 44.

Thereafter, the cable core assembly 44 is then re-cabled in a second opposite direction which results in a longer net lay length of the cable core assembly 44, e.g., a lay length of 6 inches for example, thereby reducing the helical lay length and improving both the insertion loss and the electrical delay. Such re-cabling may also relax/reduce the crushing effect of the twisted pair(s) 14, 16, etc., with the short cable lay length(s), further improving the insertion loss of the cable. The improved mechanical strength and integrity of the cable core assembly 44, compared to the individual twisted pairs 14, 16, 18 or 20 within the cable 12, eliminates, or generally minimizes, the effects on the electrical properties due to the second cabling operation.

If desired, one or more adhesive bands or filaments (not shown) may be wrapped around metallic hoop wrap 22, in an opposite helical direction, to assist further with maintaining the structural integrity of those components during subsequent manufacture, handling and installation of the cable 12. Lastly, a conventional exterior cover or jacket 42 surrounds and encases all the components together to form the cable 12.

According to one embodiment, the two insulated conductors 24, 26 of each of the first, the second, the third and the fourth twisted pairs 14, 16, 18 or 20 has a copper conductor with a diameter which is selected so as to provide no more than 4% of a resistance difference from any twisted pair of the assembly to any other twisted pair of the assembly.

The wrapped twisted pairs, generally discussed above, each normally have two separate metallic shielding tapes 30, 32 wrapped therearound in which the inner tape 30 extends in a longitudinal direction of one of the individual twisted pairs 14, 16, 18 or 20, accommodated within the cable 12, while the outer tape 32 is wrapped around both the inner metallic shielding tape 30 and one of the individual twisted pairs 14, 16, 18 or 20. One key purpose of the inner longitudinal tape 30 is to provide a completely generally uninterrupted longitudinal electrical path around the twisted pair 14, 16, 18 or 20. However, there still typically remains a small gap, about 1 mil thick, which is formed between the overlapped longitudinal edges of the inner wrap. One function of the outer metallic shielding tape 32, on the other hand, is to provide additional mechanical integrity to the twisted pair, e.g., twisted pair 14, 16, 18 or 20, in order to maintain the electrical performance of the twisted pair and the cable 12. A further function of the outer metallic shielding tape 32 is to provide electrical contact across the overlapped area of the inner, longitudinal tape or wrap.

Figure 20:
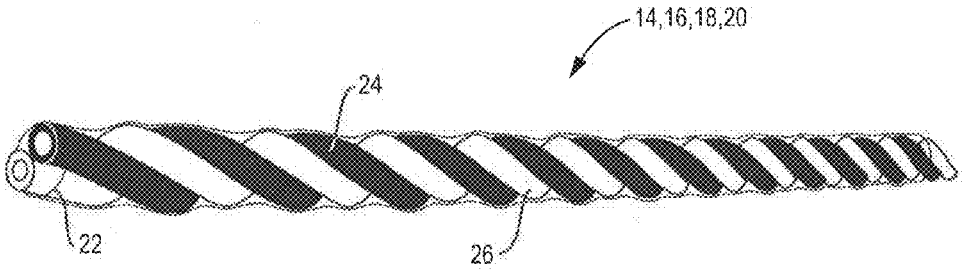
FIG. 20 is a diagrammatic perspective illustration which shows a pair of insulated conductors twisted together to form a twisted pair and wrapped with a dielectric layer or wrap.
Figure 21:
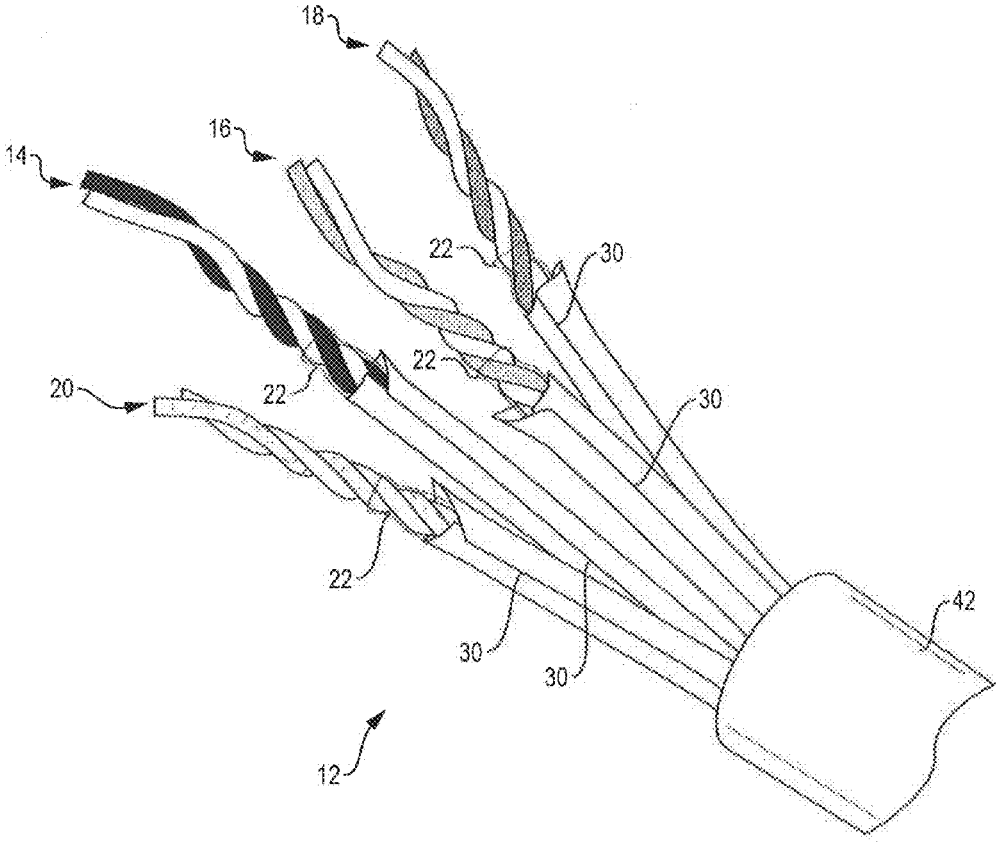
FIG. 21 is a diagrammatic perspective illustration showing an embodiment in which each one of the four twisted pairs is immobilized by a dielectric layer or wrap and then shielded by a single metallic wrap and encased within an exterior jacket to form an improved cable according to the present disclosure.

The inventors have discovered that a construction with a wrap of a dielectric wrap over each one of the twisted pairs 14, 16, 18 or 20 thereby provides a sufficient hoop strength to each respective twisted pair and is shown to minimize the disturbances in the pair geometry over the length of the twisted pair 14, 16, 18 or 20 in a completed cable 12 which is caused by the action of cable processing equipment. One embodiment for addressing this problem is shown in FIGS. 20 and 21 of the drawings. As generally shown in both of these figures, each one of the twisted pairs 14, 16, 18 or 20 is encased or surrounded by a dielectric layer (e.g., a polyester film) or wrap 22. For example, the first twisted pair 14 with shortest lay length is encased or surrounded by a dielectric layer or wrap 22, the second twisted pair 16 with the second shortest lay length is encased or surrounded by a dielectric layer or wrap 22, the third twisted pair 18 with the second longest lay length is encased or surrounded by a dielectric layer or wrap 22 and the fourth twisted pair 20 with the longest lay length is encased or surrounded by a dielectric layer or wrap 22. Typically, each of dielectric layers or wraps 22, which encase or wrap around the respective twisted pair 14, 16, 18 or 20 is manufactured from the same dielectric material.

Alternatively, if desired, the first twisted pair 14 with shortest lay length and the second twisted pair 16 with the second shortest lay length may each be encased or surrounded by a dielectric layer or wrap 22 which has a relatively low dielectric constant material (e.g., having a dielectric constant of about 1.5, for example), while the fourth twisted pair 20 with the longest lay length and the third twisted pair 18 with the second longest lay length are each encased or surrounded by a dielectric layer or wrap 22 which has a relatively high dielectric constant material (e.g., having a dielectric constant of about 4.0, for example), such as a solid insulation. By appropriate selection of the dielectric layers or wraps 22, the propagation delay differences of the various twisted pairs 14, 16, 18 or 20, which have different lay lengths L, can be easily readily and easily compensation for so that any electric signal, which travels along each one of the twisted pairs 14, 16, 18 or 20, will generally have the same propagation velocity.

The dielectric layers or wraps 22 which have a relatively low dielectric constant, for example, are typically appropriate materials for wrapping or otherwise binding the two insulated conductors 24, 26 of the first and the second twisted pairs 14, 16—and possibly the third twisted pair 18—with one another in order to assist with maintaining the mechanical strength and integrity of the twisted pairs, during subsequent handing thereof, while also assisting with not significantly hindering the velocity of signals traveling along the insulated conductors 24, 26 of those twisted pairs 14, 16 or 18. For the longer lay lengths L, the dielectric layers or wraps 22 which have a relatively high dielectric constant are appropriate materials for wrapping or otherwise binding the two insulated conductors 24, 26 of the third and the fourth twisted pairs 20, 18—and possibly the second twisted pair 16—with one another to assist with maintaining the mechanical strength and integrity of the twisted pairs 20, 18 or 16, during subsequent handing thereof, and also assist with sufficiently decreasing the velocity of any electrical signal(s) traveling along the insulated conductors 24, 26 of those twisted pairs 20 and 18, and possibly 16.

The hoop strength of the dielectric layers or wraps 22, which wrap each of the pair of insulated conductors 24, 26 together with one another, is affected by the stiffness, the thickness, and the spiral length and angle of the dielectric layers or wraps 22. As discussed above, it is to appreciated that an adhesive(s) can be used to adhesively bond the overlapped edges of the dielectric layers or wraps 22 with one another and thereby increase somewhat the effective hoop strength of the shorter or the longer lay length wrapping layers or tapes. However, it is to be appreciated that the adhesive layer, bonding the overlapped edges of the dielectric layers or wraps 22 to one another, can reduce, or possibly substantially eliminate, the desired electrical continuity and/or grounding function of the dielectric layers or wraps 22.

During wrapping each one of the pair of insulated conductors 24, 26 of the non-shielded pairs 14, 16, 18 or 20 with the dielectric layer or wrap 22, the dielectric layer or wrap 22 typically has a thickness of 12 microns and is sufficiently tightly wrapped so as to have a modulus of elasticity of 500 $kg/mm^2$. For example, each one of the twisted pair 14, 16, 18 or 20 is wrapped with a relatively short spiral lay length at an angle of typically between 30 and 75 degrees, e.g., 60 degrees, relative to a longitudinal axis of the cable 12 with about typically between 25% and 50% wrap overlap. Based upon the above formula with a 25% wrap overlap, the resulting hoop strength is calculated to be $500*0.012*0.866*1.25=6.495\ kg/mm^2$.

As noted above, the (hoop) dielectric layer or wrap 22 must be sufficiently tightly overlapped and wrapped around and/or over the two insulated conductors 24, 26 of the respective twisted pair 14, 16, 18 or 20 in order to provide the desired mechanical strength and integrity thereto. For each dielectric layer or wrap 22, the wrap circumference for the twisted pair 14, 16, 18 or 20 should assure a tight wrap for maintaining electrical performance of the cable 12. The circumference of the wrap, for wrapping the two insulated conductors 24, 26 of the twisted pair 14, 16, 18 or 20 according to the present invention, should be no more than about 5% greater than the dielectric pair minimum circumference at any point along the length of the twisted pair 14, 16, 18 or 20. That is, the circumference of the dielectric layer or wrap 22 should range no greater than between 0.0% and 5.0% the dielectric pair minimum circumference of the two insulated conductors 24, 26 so that the dielectric layer or wrap 22 constantly and continuously maintains the mechanical strength and integrity of the wrapped insulated conductors 24, 26 of the twisted pair 14, 16, 18 or 20 and thus prevents the two wrapped insulated conductors 24, 26 from becoming sufficiently separated or spaced apart from one another during subsequent handling and/or installation of the cable 12.

In addition, according to this embodiment as shown in FIG. 21, once each one of the twisted pairs 14, 16, 18, 20 is sufficiently tightly wrapped with the dielectric layer or wrap 22, then a respective single layer 30 of a metallic shield tape is wrapped around each respective one of twisted pairs 14, 16, 18 or 20. During such wrapping, the single layer or tape 30 is wrapped so as to have a very long lay length, e.g., as generally shown in FIG. 21, the lay length L of the single layer 30 is typically between a few inches and infinity. The single layer 30 is wrapped so that at least a metallic surface 34, of the first layer 30 typically faces outwardly and away from the two insulated conductors 24, 26 of the twisted pair 14, 16, 18 or 20. This single layer 30 is designed to provide reliable shielding and grounding of the respective wrapped twisted pair 14, 16, 18 or 20.

Lastly, as shown in FIG. 21, the wrapped twisted pair 14, 16, 18 or 20 are surrounded and encased by a conventional exterior cover or jacket 42 to form the cable 12. Just prior to the wrapped twisted pair 14, 16, 18 or 20 being encased by the exterior cover or jacket 42, each one of the wrapped twisted pair 14, 16, 18 or 20, along with the single layer 30 surrounding the respective wrapped twisted pair 14, 16, 18 or 20, is twisted in a first direction to add a twist lay of between 2 and 5 inches. As a result of such twisting action, each of the wrapped twisted pair 14, 16, 18 or 20 and the associated single layer 30 have substantially the same twist lay length, e.g., typically between 2 and 5 inches or so. Such twisting of the wrapped twisted pair 14, 16, 18 or 20 and the associated single layer 30 continues along the entire length of the cable 12 as the cable is being manufactured so that a complete 360 degree twist of the cable internal components occurs every 2 to 5 inches or so along the length of the cable 12.

If desired or required, a "+-shaped spacer" (not shown in FIG. 21) may be utilized to assist with separating and spacing each one of the first, the second, the third and the fourth twisted pairs 14, 16, 18 or 20 from one another. Alternatively, a central spacer 38 (not shown in detail FIG. 21) may be located substantially along a central axis of the cable. The central spacer 38 has a conductive metallic exterior surface which extends along the entire length of the central space 38 so that, following assembly of the cable 12, the metallic surface of each one of the single wraps electrically contacts the conductive metallic exterior surface of the central spacer to assist with provide shielding and grounding of the first, the second, the third and the fourth twisted pairs 14, 16, 18 or 20. Also, if desired or required, one or more adhesive bands or filaments (not shown) may be wrapped around each one of the single layers 30 to assist further with maintaining the structural integrity of the single layer 30 with the wrapped twisted pair 14, 16, 18 or 20 during subsequent manufacture, handling, installation and/or use of the cable 12.

Further, an optional wire braid or a metallic hoop wrap 22 be may wrapped around all of the twisted pairs 14, 16, 18, 20 (similar to the arrangement shown in FIGS. 19A-19C) in order to immobilized and bind further all of the plurality of twisted pairs 14, 16, 18, 20, e.g., the formed cable core assembly 44, with one another and prevent the respective first and the second insulated conductors 24, 26, of each one of the twisted pairs 14, 16, 18 or 20, from separating from one another during subsequent handling, manufacture, installation and/or use of the cable 12. The metallic hoop wrap 22 also assists with shielding of the plurality of twisted pairs 14, 16, 18, 20 of the cable core assembly 44.

As generally shown in FIGS. 22, 22A, 23 and 23A, in order to provide improved handling and improved mechanical strength for the shielded twisted pair, according to this embodiment of the present invention, the metallic shielding tape 30 typically has a width of about ¾+¼ of an inch or so. The metallic shielding tape 30 typically comprises both a metallic layer 50 and a dielectric (e.g., polyester) layer 52. The metallic layer 50 typically extends along the complete length and width of the metallic shielding tape 30 and generally has a thickness of between 0.25 and 3 mils, and more preferably a thickness of about 1 mil, while the dielectric layer 52 extends along the complete length and width of the metallic shielding tape 30 and generally has a thickness of between 0.25 and 3 mils, and more preferably a thickness of about 1 mil.

Figure 24:
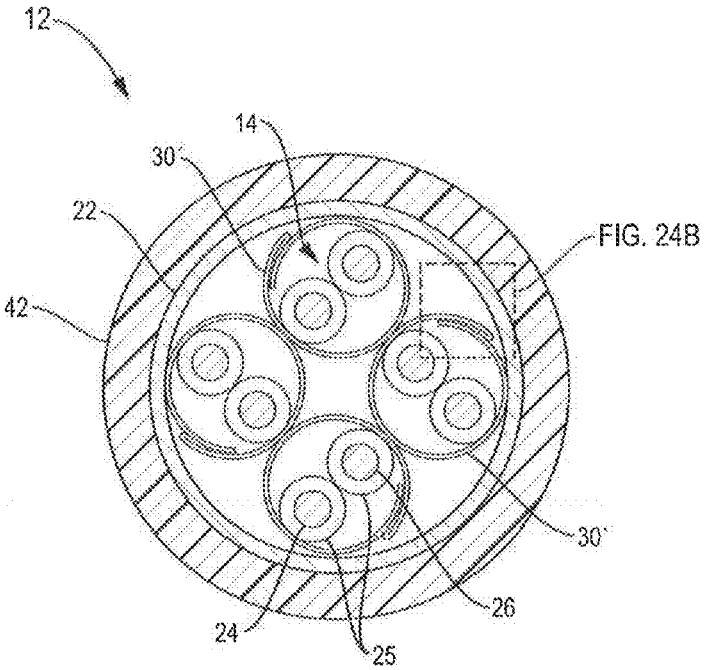
FIG. 24 diagrammatically illustrates a metallic pair minimum circumference for a pair of metallic wraps which both completely circumscribe two insulated conductors.
Figure 24A:
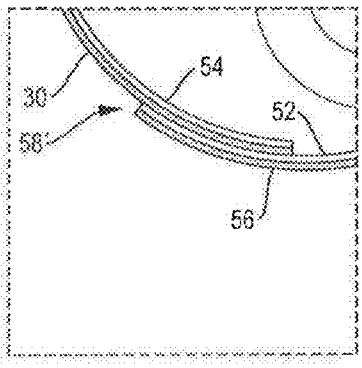
FIG. 24A is an enlarged view of area A of FIG. 24 which shows the metal-to-metal electrical contact along the overlapped longitudinal edge region of the metallic shielding tape, according to the disclosure.

It is to be appreciated, however, that when such single metallic shielding tape 30 is wrapped around one of the twisted pairs 14, 16, 18 or 20, for example as shown in FIG. 24A, there is a small section where no metal-to-metal contact occurs between the metallic layers 50 of the two longitudinal edge sections 54, 56 of the metallic shielding tape 30 which overlap one another along in the overlapped longitudinal edge region 58. That is, the outwardly facing metallic layer 50 of the inner overlapped edge 54 directly abuts against the inwardly facing dielectric layer 52 of the outer overlapped edge 56, but not against the metallic layer 50 of the outer overlapped edge 56, and thus forms a small gap about 1 mil thick which has a tendency to permit some of the generated eddy currents and/or other electric field/ energy to escape through this small gap formed in the metallic shield. As a result, this lack of metal-to-metal electrical contact, along the overlapped longitudinal edge region 58, generally results in an indirect spiral conductive path, once the metallic shielding tape 30 is wrapped around one of the individual twisted pairs 14, 16, 18 or 20. The inventors have determined that such indirect spiral conductive path increases the effective resistance of the metallic shielding tape 30 and can also result in electrical problems, such as crosstalk between the twisted pairs 14, 16, 18 or 20 which is undesirable and is to be avoided.

Figure 22:
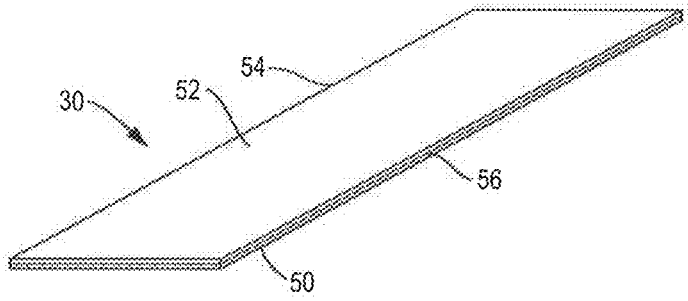
FIG. 22 is a diagrammatic perspective illustration of the metallic shield tape, according to an improvement of the present invention, prior to folding of the metallic shield tape along one longitudinal edge thereof.
Figure 22A:
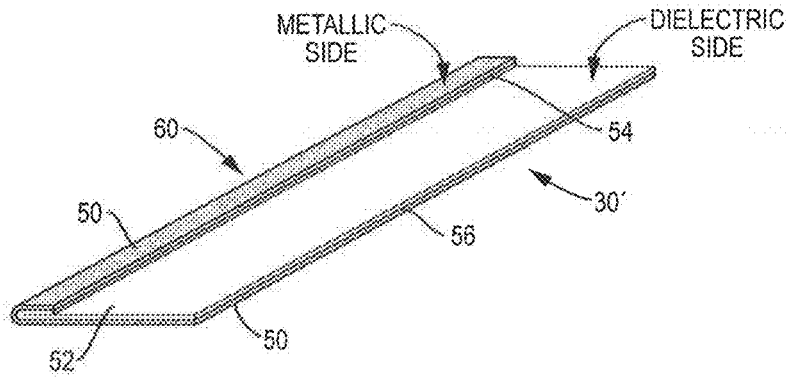
FIG. 22A is a diagrammatic perspective illustration of the metallic shield tape of FIG. 22 following folding of the metallic shield tape along one longitudinal edge thereof.
Figure 23:
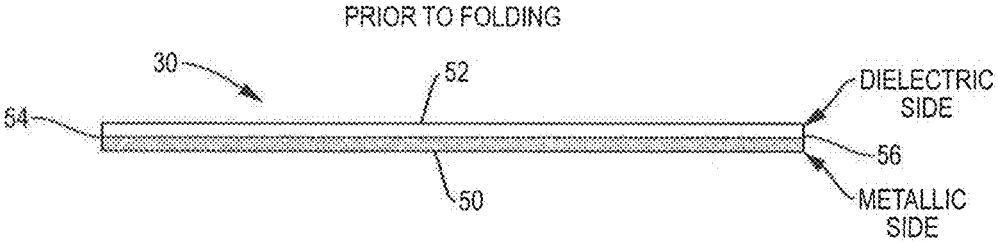
FIG. 23 is a diagrammatic left end illustration of the metallic shield tape of FIG. 22, prior to folding of the metallic shield tape along one longitudinal edge thereof.
Figure 23A:
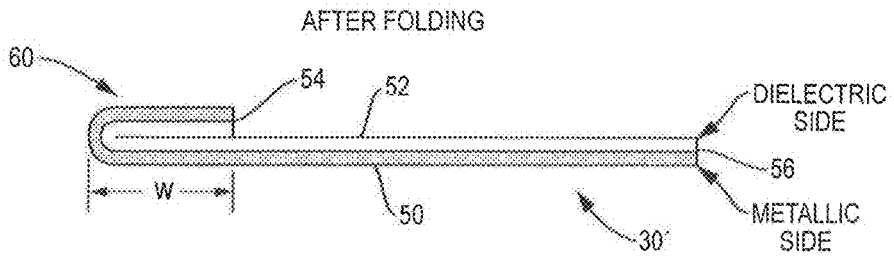
FIG. 23A is a diagrammatic left end view of the metallic shield tape of FIG. 22A, following folding of the metallic shield tape along one longitudinal edge thereof.

The improvement, according to this embodiment of the invention as shown in FIGS. 22A and 23A, relates to folding over one longitudinal edge of the metallic shielding tape 30' back onto itself so as to form a dual layered folded-over longitudinal edge 60, as generally shown in FIGS. 22A and 23A, and then use this folded over metallic shielding tape 30' to wrap around each one of the twisted pairs 14, 16, 18 or 20. That is, a first one of the two longitudinal edge sections 54 or 56 of the metallic shielding tape 30' is folded back over onto itself (see FIGS. 22A and 23A) so that the inwardly facing dielectric layer 52 directly abuts against itself and forms the dual layered folded-over longitudinal edge 60 in which the metallic layer 50 is facing outwardly throughout the entire in the dual layered folded-over longitudinal edge 60. Typically the folded-over longitudinal edge 60 has a width W of between about 1/16 and 1/5 of an inch or so, and more preferably a width W of about 1/8 of an inch or so. The folded-over longitudinal edge 60 typically extends along the complete longitudinal length of the metallic shielding tape 30, from a first end of the metallic shielding tape 30 to an opposed second end of the metallic shielding tape 30, as generally shown in FIG. 22A.

Figure 24B:
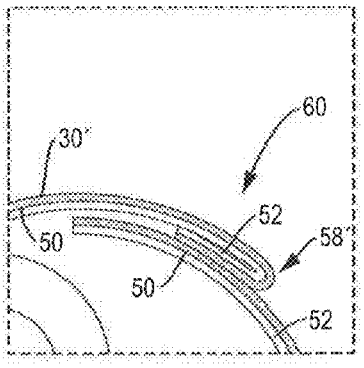
FIG. 24B is an enlarged view, similar to area A of FIG. 24, showing a small section where there is not any metal-to-metal contact between the metallic layers of the two longitudinal edge sections of the metallic shielding tape which overlap one another along in the overlapped longitudinal edge region.

The dual layered folded-over longitudinal edge 60, following wrapping around one of the individual twisted pairs 14, 16, 18 or 20 with a typical wrap length of between 0.25 and 2.4 inches, for example, and more preferable a wrap length of about 1 inch or so as generally shown in FIGS. 24, 24A and 24B, thereby results in direct metal-to-metal electrical contact between the two overlapped longitudinal edge sections 54, 56 of the metallic shielding tape 30' in the overlapped longitudinal edge region 58' (see FIG. 24B). As a result of such direct metal-to-metal contact, between the two overlapped longitudinal edge sections 54, 56 of the metallic shielding tape 30' in the overlapped longitudinal edge region 58', the metallic shielding tape 30' now achieves and provides both (1) a complete 360 degree circumferential metallic shielding around the twisted pair, e.g., twisted pair 14, 16, 18 or 20, and (2) this complete 360 degree circumferential metallic shield, around the twisted pair, also extends completely and uninterrupted from a first leading end of the metallic shielding tape 30' to an opposed second trailing end of the metallic shielding tape 30' thereby by providing a complete, uninterrupted metallic shield around the twisted pair 14, 16, 18 or 20, without any break and/or gap formed therein or along the length of the twisted pair 14, 16, 18 or 20.

As a result of the above described complete, uninterrupted metallic shield around the twisted pair 14, 16, 18 or 20, the twisted pair is completely wrapped and shielded by only a single metallic shielding tape 30' and the electrical properties—formerly achieved by employing two separate and distinct wraps or tapes—can be easily and readily be achieved and accomplished by using just a single metallic shielding tape 30' which has the dual layered folded-over longitudinal edge 60. That is, the dual layered folded-over longitudinal edge 60, of the metallic shielding tape 30', achieves both a complete longitudinal conductive path and a complete circumferential conductive path around the twisted pair, e.g., twisted pair 14, 16, 18 or 20, by using only a single metallic shielding tape 30'.

The cable typically has a nominal lay length of between 4 and 12 inches.

As noted above, small anomalies in the twisted pair and the cable geometry are created by the process and machinery which twists and assembles the cable components, with the anomalies typically created at intervals corresponding to the twist lengths. There are several twist lengths within a cable, which include the pair twist length, the length of the twist of a wrap or wraps around the pair, the length of the twist of the pairs as they are assembled together, and the spiral length of a wrap of a tape or wires around the cable core. These anomalies created by the twisting actions are visible in the electrical results, and the anomalies may interact to create an electrical performance artifact at frequencies not directly corresponding to a specific twist length of a single component.

Also as discussed above, one conventional method of constructing a cable core is to feed individual pairs in to a machine that forms the twisted core, and each of the pairs are provided with a tape wrap as they enter the machine. The twisting action of the machine both wraps the each tape around each pair and forms the twisted cable core. The twist rate of the pair tape wrap is the same as the twist rate of the twisted pairs within the cable as they form the cable core. This process is widely used in cable manufacture, but also is known to induce anomalies in the pair geometry at the twist length of the core, which are to be avoided, as much as possible.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

Wherefore, we claim:

1. A cable for carrying signals having frequencies in the range of 2,000 MHZ, the cable comprising:

a plurality of pairs, with each pair comprising first and second insulated conductors;

the first and the second insulated conductors, of each of the plurality of pairs, being twisted with one another to form a twisted pair, and each of the twisted pairs having a different lay length from one another so that one of the plurality of twisted pairs has a shortest lay length and another of the plurality of twisted pairs has a longest lay length;

each of the plurality of twisted pairs being separately wrapped with a hoop strength wrap which maintains mechanical strength and integrity of each one of the twisted pairs during subsequent handing thereof, and a circumference of hoop strength wrap is about 5% or less than a pair minimum circumference of the first and the second insulated conductors of the respective twisted pair;

the plurality of twisted pairs being twisted with one another to form a twisted cable core assembly having a desired lay length of 6 inches or less;

at least one first metallic wrap being provided for shielding and grounding of at least one of the plurality of twisted pairs;

the first and the second insulated conductors, of each of the plurality of twisted pairs, being pretwisted to have a twist length that is less than or equal to 0.5 wavelengths of 2,000 MHZ; and the plurality of twisted pairs and the at least one metallic tape being surrounded and encased by a conventional exterior jacket to form the cable capable of carrying signals having frequencies in the range of 2.000 MHZ.

2. The cable according to claim 1, wherein the plurality of twisted pairs comprise first, second, third and fourth twisted pairs, and the at least one first metallic wrap comprises first, second, third, and fourth first metallic wraps, the first first metallic wrap wraps around the first twisted pair, the second first metallic wrap wraps around the second twisted pair, the third first metallic wrap wraps around the third twisted pair, and the fourth first metallic wrap wraps around the fourth twisted pair in order to provide shielding and grounding of each of the plurality of twisted pairs with respect to another and an exterior of the cable.

3. The cable according to claim 2, wherein each of the first metallic wraps has an outwardly facing metal surface, and each one of the first, the second, the third and the fourth twisted pairs is also wrapped by a second metallic wrap which has an inwardly facing metal surface, and the outwardly facing metal surface of each of the first metallic wraps contacts with the inwardly facing metal surface of the respective second metallic wrap to provide shielding and grounding of each of the first, the second, the third and the fourth twisted pairs with respect to another and an exterior of the cable.

4. The cable according to claim 2, wherein each of the first, the second, the third and the fourth metallic wraps has a dual layered folded-over longitudinal edge such that when the first, the second, the third and the fourth metallic wraps with the dual layered folded-over longitudinal edge are respectively wrapped around the first, the second, the third and the fourth twisted pairs, each of the first, the second, the third and the fourth metallic wraps, with the dual layered folded-over longitudinal edge, achieves a metal-to-metal contact between overlapped longitudinal edge sections.

5. The cable according to claim 4, wherein the dual layered folded-over longitudinal edge is achieved by folding one longitudinal edge section of each respective first metallic wrap back over onto itself so that a dielectric layer directly abuts against itself and forms the dual layered folded-over longitudinal edge and a metallic layer is facing outwardly throughout an entire length of the dual layered folded-over longitudinal edge.

6. The cable according to claim 4, wherein the folded-over longitudinal edge has a width of between about 1/16 and 1/5 of an inch or so and extends along a complete longitudinal length of each respective first metallic wrap from a first end thereof to an opposed second end thereof; and a metallic layer extends a complete length and width of each respective first metallic wrap and has a thickness of between 0.25 and 3 mils, while a dielectric layer extends the complete length and width of each respective first metallic wrap and has a thickness of between 0.25 and 3 mils.

7. The cable according to claim 4, wherein each respective first metallic wrap with the dual layered folded-over longitudinal edge results in a direct metal-to-metal contact, between two overlapped longitudinal edge sections of each respective first metallic wrap, in an overlapped longitudinal edge region so that each respective first metallic wrap provides both a complete 360 degree circumferential metallic shielding around the twisted pair and this complete 360 degree circumferential metallic shielding around the twisted pair extends completely and uninterrupted from a first leading end of each respective first metallic wrap to an opposed second trailing end of each respective first metallic wrap thereby providing a complete, uninterrupted metallic shield for the twisted pair, without any break and/or gap formed therein.

8. The cable according to claim 2, wherein a central spacer is located substantially along a central axis of the cable and the central spacer has a metallic conductive exterior surface which provides a longitudinal conductive path along the cable, and, following assembly of the cable, each first metallic wrap contacts the metallic conductive surface of the central spacer to assist with provide shielding and grounding of the cable.

9. The cable according to claim 1, wherein the plurality of twisted pairs comprise first, second, third and fourth twisted pairs and at least a first adhesive band or filament wraps around the first, the second, the third and the fourth twisted pairs to prevent separation of the first, the second, the third and the fourth twisted pairs from one another.

10. The cable according to claim 1, wherein the at least one first metallic wrap comprises part of each one of the hoop strength wraps so as to form a metallic hoop strength wrap, and the metallic hoop strength wrap provides mechanical strength and integrity of each of the twisted pairs while also providing shielding and grounding thereof.

11. The cable according to claim 10, wherein the plurality of twisted pairs comprise first, second, third and fourth twisted pairs and at least one of a first adhesive band or a filament wraps around the first, the second, the third and the fourth twisted pairs to prevent separation of the first and the second insulated conductors from one another.

12. The cable according to claim 1, wherein the plurality of twisted pairs comprise first, second, third and fourth twisted pairs and the at least one first metallic wrap wraps around the first, the second, the third and the fourth twisted pairs, and the at least one first metallic wrap comprises a dual layered folded-over longitudinal edge which achieves a metal-to-metal contact between overlapped longitudinal edge sections of the at least one first metallic wrap, once the at least one first metallic wrap is wrapped around all of the first, the second, the third and the fourth twisted pairs.

13. The cable according to claim 1, wherein the plurality of twisted pairs comprise first, second, third and fourth twisted pairs which are assembled with one another to form the cable core assembly, and the cable core 4-assembly is cabled at a lay length of about 2 inches or less in a first cabling direction so that the lay length imparts electrical problems at frequencies above a frequency range of interest, and then the cable core assembly is re-cabled in an opposite second cabling direction, which results in a longer net lay length of the cable core assembly thereby reducing a helical length and improving both insertion loss and electrical delay of the cable.

14. The cable according to claim 13, wherein, following cabling of the cable core assembly in the first cabling direction, the cable core assembly is wrapped with an additional wrap which provides additional mechanical strength and integrity to the cable core assembly.

15. The cable according to claim 1, wherein the plurality of twisted pairs comprise first, second, third and fourth twisted pairs, and the at least one first metallic wrap wraps around all of the first, the second, the third and the fourth twisted pairs and provides shielding and grounding of the first, the second, the third and the fourth twisted pairs with respect to an exterior of the cable.

16. The cable according to claim 15, wherein at least one of a first adhesive band or a filament wraps around the at least one metallic wrap to prevent separation of the at least one metallic wrap from the first, the second, the third and the fourth twisted pairs.

17. The cable according to claim 1, wherein the plurality of twisted pairs comprise first, second, third and fourth twisted pairs and at least one of:

the first, the second, the third and the fourth twisted pairs of the cable are assembled with one another to form the cable in an SZ arrangement; and the cable has a nominal lay length of between 4 and 12 inches.

18. The cable according to claim 1, wherein the cable is assembled in a substantially linear configuration to form the cable core assembly, and thereafter the cable is recabled to maintain an absent of electrical anomalies below 2,000 MHZ.

19. A cable comprising:

a plurality of pairs, with each pair comprising first and second insulated conductors;

the first and the second insulated conductors, of each of the plurality of pairs, being twisted with one another to form a twisted pair, and each of the twisted pairs having a different lay length from one another so that one of the plurality of twisted pairs has a shortest lay length and another of the plurality of twisted pairs has a longest lay length;

each of the plurality of twisted pairs being wrapped with a hoop strength wrap which maintains mechanical strength and integrity of each of the twisted pairs during subsequent handing thereof, and a circumference of hoop strength wrap is about 5% or less than a pair minimum circumference of the first and the second insulated conductors of the twisted pair;

the plurality of twisted pairs comprise first, second, third and fourth twisted pairs, and a plurality of first metallic wraps, the first twisted pair is wrapped by a first one of the plurality of first metallic wraps, the second twisted pair is wrapped by a second one of the plurality of first metallic wraps, the third twisted pair is wrapped by a third one of the plurality of first metallic wraps and the fourth twisted pair is wrapped by a fourth one of the plurality of first metallic wraps in order to provide shielding and grounding of each of the plurality of twisted pairs with respect to another and an exterior of the cable; and the plurality of twisted pairs and the plurality of first metallic wraps being surrounded and encased by a conventional exterior jacket to form the cable;

wherein the two insulated conductors, which form the first twisted pair which has the shortest lay length, are encased by the hoop strength wrap which has a lowest dielectric constant, the two insulated conductors, which form the second twisted pair which has a second shortest lay length, are encased in the hoop strength wrap which has a second lowest dielectric constant, the two insulated conductors, which form the fourth twisted pair which has the longest lay length, are encased in the hoop strength wrap which has a highest dielectric constant, and the two insulated conductors, which form the third twisted pair which has a second longest lay length, are encased in the hoop strength wrap which has a second highest dielectric constant.

20. A cable comprising:

a plurality of pairs, with each pair comprising first and second insulated conductors;

the first and the second insulated conductors, of each of the plurality of pairs, being twisted with one another to form a twisted pair, and each of the twisted pairs having a different lay length from one another so that one of the plurality of twisted pairs has a shortest lay length and another of the plurality of twisted pairs has a longest lay length;

each of the plurality of twisted pairs being wrapped with a hoop strength wrap which maintains mechanical strength and integrity of each of the twisted pairs during subsequent handing thereof, and a circumference of hoop strength wrap is about 5% or less than a pair minimum circumference of the first and the second insulated conductors of the twisted pair;

the plurality of twisted pairs comprise first, second, third and fourth twisted pairs;

at least one metallic wrap surrounding all of the first, the second, the third and the fourth twisted pairs for providing for shielding and grounding thereof;

the first, the second, the third and the fourth twisted pairs and the at leas one metallic wrap being surrounded and encased by a conventional exterior jacket t form the cable; and each of the hoop strength wraps are dielectric wraps, each of the first, the second, the third and the fourth twisted pairs have a copper conductor with a diameter which is selected so as to provide no more than 4% of a resistance difference with respect to any twisted pair of a cable core assembly to any other twisted pair of the cable core assembly;

a percentage difference of a lay length of a twisted pair with a second shortest lay length is between about 15% and about 30% greater than a lay length of a twisted pair with the shortest lay length;

a percentage difference of a lay length of a twisted pair with a second longest lay length is between about 30% and about 45% greater than the lay length of the twisted pair with the second shortest lay length;

a percentage difference of a lay length of the twisted pair with the longest lay length is between about 45% and about 60% greater than the lay length of the twisted pair with the second longest lay length; and the first, the second, the third and the fourth twisted pairs each have lay lengths such that the resonant length of any combination of the first, the second, the third and the fourth twisted pairs, accommodated within the cable, is no greater than about % the wavelength of 2,000 MHZ so that a resonance length of the first, the second, the third and the fourth twisted pairs is less than 2 inches.

* * * * *